US005545605A

United States Patent [19]

Imai et al.

[11] Patent Number: 5,545,605

[45] Date of Patent: Aug. 13, 1996

[54] THERMAL TRANSFER PRINTING METHOD AND IMAGE-FORMING LAYER TRANSFER MEDIUM

[75] Inventors: Akihiro Imai, Ikoma; Yasuo Fukui; Hiroyuki Matsuo, both of Osaka, all of Japan

[73] Assignee: Matsushita Electric Industrial Co., Ltd., Osaka, Japan

[21] Appl. No.: 345,686

[22] Filed: Nov. 21, 1994

[30] Foreign Application Priority Data

Nov. 22, 1993 [JP] Japan ..... 5-292050
Jun. 27, 1994 [JP] Japan ..... 6-144842

[51] Int. Cl.[6] ..... B41M 5/035; B41M 5/38

[52] U.S. Cl. ..... 503/227; 428/195; 428/913; 428/914

[58] Field of Search ..... 8/471; 156/235, 156/239, 240; 428/195, 913, 914; 503/227

[56] References Cited

U.S. PATENT DOCUMENTS 5,053,381 10/1991 Chapman et al. ..... 503/227

FOREIGN PATENT DOCUMENTS 62-297184 12/1987 Japan ..... 503/225
172893 3/1989 Japan ..... 503/225
187390 3/1989 Japan ..... 503/225
1122485 5/1989 Japan .
1160682 6/1989 Japan .
1225591 9/1989 Japan .
4141486 5/1992 Japan .
4201492 7/1992 Japan ..... 503/227
5238164 9/1993 Japan ..... 503/225
143831 5/1994 Japan .

*Primary Examiner*—B. Hamilton Hess
*Attorney, Agent, or Firm*—Lowe, Price, LeBlanc & Becker

[57] ABSTRACT

A thermal transfer printing method, in a combination of a transfer medium including a support on which at least a dyeing layer and a dye anti-diffusion layer (and a protecting layer) are provided separately from color layers, an intermediate medium, and an image-receiving medium, comprising steps of: transferring at least the dye anti-diffusion layer and the dyeing layer (and the protecting layer) onto the intermediate medium, thereby forming a sequential laminate on the intermediate medium; printing a thermal transfer image in the dyeing layer of the laminate formed on the intermediate medium; and transferring the laminate carrying the thermal transfer image thereon from the intermediate medium onto the image-receiving medium (and fixing it simultaneously, or after transferring), thereby finally forming a print image on the image-receiving medium. A novel image-forming layer transfer medium used in the above thermal transfer printing method, has various properties in area of each layer, thermal characteristics, arrangement of respective layers etc. According to the printing method and the image-forming layer transfer medium, the print image obtained causes no contamination by dyestuff and print density is not lowered by the loss of dyestuff, bringing high-temperature stability in maintaining the transfer medium in a wound condition, and/or realizing a low-temperature transfer operation of the image-forming layer onto the image-receiving medium.

13 Claims, 11 Drawing Sheets

THERMAL TRANSFER PRINTING METHOD AND IMAGE-FORMING LAYER TRANSFER MEDIUM

BACKGROUND OF THE INVENTION

1. Field of the Invention

The present invention relates to a thermal transfer printing method and an image-forming layer transfer medium using a printing means such as a thermal head, an optical head like a laser, and electrical head, and more particularly to a thermal transfer printing method and an image-forming layer transfer medium capable of obtaining an excellent printing image on any type of image-receiving medium such as a plain paper in a sublimation type thermal transfer printing.

2. Description of the Prior Art

In the thermal transfer printing of sublimation type, there is known a method of forming a dyeing layer first on an intermediate medium, then printing a thermal transfer image into the dyeing layer on the intermediate medium, and subsequently transferring thus printed dyeing layer onto an image-receiving medium such as a plain paper, thereby finally forming an image on the image-receiving medium. (For example, Unexamined Japanese Patent Application No. HEI 4-141486)

In such a conventional printing method, a problem will arise when, after the image is once printed on the intermediate medium, the printed dyeing layer is transferred from the intermediate medium to the image-receiving medium. More specifically, the dyeing layer is subjected to application of heat when the image is printed into the dyeing layer and/or when the dyeing layer is transferred to a plain paper. If the printing density of the dyeing layer is too high, a part of dyestuff possibly penetrates the dyeing layer and possibly contaminates the intermediate medium. Since the intermediate medium is repeatedly used, the next dyeing layer is newly formed on the intermediate layer to print the image in this dyeing layer and then transfer the image onto the image-receiving medium in the same manner as the previous printing operation. Thus, there is a possibility that the previously printed image remaining on the intermediate medium may be unwantedly transferred onto the newly formed dyeing layer, thus causing a problem that the old print image contaminates the new print image formed in the new dyeing layer.

Furthermore, penetration of dyestuff through the dyeing layer will cause another problem such that the print density obtained is lower than expected. This is because a part of dyestuff penetrates the dyeing layer so deep that it dyes the intermediate medium, for example, in a case where the dyestuff to be completely maintained in the dyeing layer during a printing operation partly includes a higher print density region, or in a case where numerous colors are simultaneously printed.

Moreover, another problem will arise when a material having low glass transition point (or softening point) is adopted as a dyeing layer in order to gain excellent printing sensitivity. Because, the dyeing layer on a support may be thermally melted onto the reverse surface of the support when the transfer medium including the dyeing layer is maintained in a wound condition at a higher temperature.

Meanwhile, maintaining the dyeing layer at a lower temperature is normally required when the dyeing layer is transferred from the transfer medium to the intermediate medium, or when the dyeing layer is transferred from the intermediate layer to the image-receiving medium such as a plain paper.

SUMMARY OF THE INVENTION

Accordingly, in view of above-described problems encountered in the prior art, a principal object of the present invention is to provide a thermal transfer printing method and an image-forming layer transfer medium capable of preventing contamination of dye on an image-receiving medium in a sublimation type thermal transfer printing, guaranteeing a printing image whose print density is not lowered by the loss of dyestuff, bringing high-temperature stability in maintaining the transfer medium in a wound condition, and/or realizing a low-temperature transfer operation of the image-forming layer onto the image-receiving medium.

In order to accomplish this and other related objects, the present invention provides a printing method, which uses an image-forming layer transfer medium comprising at least a dyeing layer and a dye anti-diffusion layer on a support thereof, or an image-forming layer transfer medium comprising at least a dyeing layer and a dye anti-diffusion layer and a protecting layer on a support thereof, transfers and forms a laminate including at least the dye anti-diffusion layer and the dyeing layer (or the dye anti-diffusion layer, the protecting layer and the dyeing layer) onto an intermediate medium, prints a thermal transfer image into the dyeing layer of the laminate, and transfers the laminate from the intermediate medium to an image-receiving medium (or further fixing it), thereby finally obtaining a print image on the image-receiving medium.

The present invention further provides an image-forming layer transfer medium comprising at least a dyeing layer and a dye anti-diffusion layer on a support thereof, or an image-forming layer transfer medium comprising at least a dyeing layer and a dye anti-diffusion layer and a protecting layer on a support thereof, or the one characterized by area of each layer, thermal characteristics, and/or arrangement of respective layers.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
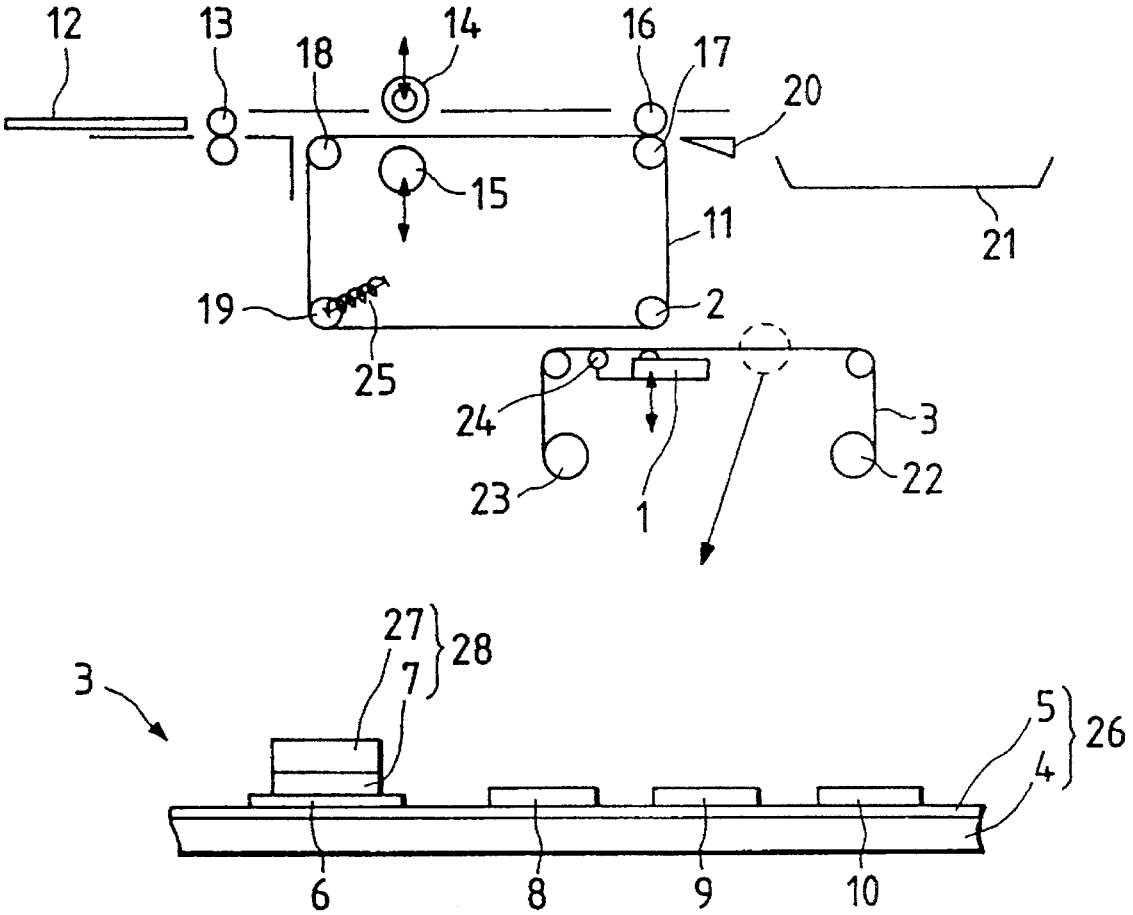
FIGS. 1 through 5 are schematic views showing principles of the printing method in accordance with preferred embodiments of the present invention.

FIG. 1 is a schematic view showing a principle of the printing method in accordance with a preferred embodiment of the present invention. In FIG. 1, there is shown an image-forming layer transfer medium 3 having a laminate 28 essentially consisting of a dyeing layer 7 and a dye anti-diffusion layer 27 and color layers 8, 9 and 10 which are separated from each other and sequentially disposed along the surface of a support 26.

In the following description of the present invention, the image-forming layer transfer medium 3 or a dye transfer medium may be referred simply as "transfer medium". If a plurality of separated transfer media including an image-forming layer transfer medium, e.g. a combination of an image-forming layer transfer medium and a dye transfer medium, are used, "transfer medium" will represents each of the plurality of transfer media or all of them as a whole. By the way, the dye transfer medium has at least a color layer on a support thereof, and does not have a dyeing layer on the support thereof.

An image-forming layer transfer medium 3, shown in FIG. 1 as a typical example, comprises a support, releasing layers 6, sequential laminates 28 and color layers. The support 26 consists of a polymeric film 4 and an anchor coat layer 5 formed on the polymeric film 4. The sequential laminate 28 consisting of a dyeing layer 7 and a dye anti-diffusion layer 27 is formed on the support 26 via the releasing layer 6. A yellow color layer 8, a magenta color layer 9 and a cyan color layer 10 are sequentially disposed along a surface on the support 26. (Refer to an enlarged cross-sectional view of the image-forming layer transfer medium 3.) The polymeric film 4 has a back coat layer formed on a surface opposite to the surface on which the anchor coat layer 5 is formed, for assuring satisfactory travelling characteristics to a thermal head (although FIG. 1 omits such a back coat layer).

First, a printing head 1 (e.g. a thermal head) is pushed against a platen 2 so that an intermediate medium 11 and the image-forming layer transfer medium 3 can travel together in the same direction (for example, the intermediate medium 11 causes a rotation in a clockwise direction). With heat generated from the printing head 1, the laminate 28 on the image-forming layer transfer medium 3 is then thermally transferred onto the intermediate medium 11, thus forming a laminate 28 on the intermediate medium 11.

Formation of a laminate 28 onto the intermediate medium 11, realized by the printing head 1 in FIG. 1, however is not limited to the disclosed one. A heat and/or pressure medium would be used to form a laminate 28 on the intermediate medium 11. A representative heat and/or pressure medium would be, for example, shown below as a heat and/or pressure medium used for transferring a laminate 28 from the intermediate medium 11 to the image-receiving medium 12. More specifically, the platen 2 or a roller closely provided to the printing head 1 can be a heating roller accommodating a heating means such as a halogen lamp, so that this heating roller generates heat to form a laminate 28 on the intermediate medium 11. If the surface of the intermediate medium 11 is sticky or rubber-like or rough, solely applying pressure thereon would be sufficient to transfer the laminate 28 from the image-forming layer transfer medium 3 to the intermediate medium 11 to form the laminate 28 on the intermediate medium 11.

Electrical processing (e.g. corona discharge or electrostatic charge processing) can be also applied on the intermediate medium 11 before or during the laminate 28 is formed on the intermediate medium 11. Especially, such electrical processing would be effective for an endless type intermediate medium, since the endless type intermediate medium is repeatedly used and therefore requires a surface cleaning or a surface treatment.

Next, the intermediate medium 11 is further rotated in the clockwise direction until the laminate 28 on the intermediate medium 11 returns just on or close to the platen position. Thereafter, the yellow color layer 8 of the image-forming layer transfer medium 3 is laid on top of the dyeing layer 7 of the laminate 28 on the intermediate medium 11, thereby transferring yellow image into the dyeing layer 7 by means of the printing head 1. Magenta image and cyan image are successively printed in the dyeing layer 7 in the same manner.

In this case, the dye anti-diffusion layer 27 is interposed between the dyeing layer 7 and the intermediate medium 11, thus surely preventing dyestuff printed in the dyeing layer 7 from diffusing into the intermediate medium 11.

In the formation of the laminate 28 on the intermediate medium 11, the intermediate medium 11 can be reversed toward the platen position by rotating it in the counterclockwise direction instead of causing the intermediate medium 11 to create one complete revolution in the clockwise direction. This operation can be similarly applied to the printing operation of each color. Thermal transfer image printing into the dyeing layer 7 can be realized regardless of the travelling speeds of the image-forming layer transfer medium 3 and the intermediate medium 11 which may be the same or different.

Next, the image-receiving medium 12, fed by a supply roller 13, is laid on top of the laminate 28 on the intermediate medium 11. A silicone rubber roller 14 and a heating roller 15 are pressed with each other, and then both the intermediate medium 11 and the image-receiving medium 12 pass through these paired rollers 14 and 15. The intermediate medium 11 and the image-receiving medium 12 further pass through the paired rollers 16 and 17, and thereafter the image-receiving medium 12 is separated from the intermediate medium 11. Thus, the laminate 28 is transferred from the intermediate medium 11 onto the image-receiving medium 12, thereby outputting the image-receiving medium 12 with an image printed laminate 28 thereon into a tray 21. It is, of course, possible to separate the image-receiving medium 12 from the intermediate medium 11 after it passed through the rollers 14 and 15.

In this transfer operation to transfer the laminate 28 from the intermediate medium 11 to the image-receiving medium 12, it is possible to prevent dyestuff printed in the dyeing layer 7 from diffusing into the intermediate medium 11 by heat generated during the transfer operation, because the dye anti-diffusion layer 27 is interposed between the dyeing layer 7 and the intermediate medium 11. Thus, the intermediate medium 11 is surely prevented from being contaminated by the dyestuff.

To surely separate the image-receiving medium 12 from the intermediate medium 11, it is desirable to provide a claw 20 at a position where the image-receiving medium 12 is easily separated from the intermediate medium 11 as shown in FIG. 1 as occasion demands. It will be desirable to replace the heating roller 15 with the roller 18 and provide the heating roller 15 and the silicone rubber roller 14 at the position where the roller 18 is provided. Furthermore, the heating roller 15 can be always brought into contact with the intermediate medium 11. Otherwise, the heating roller 15 can be brought into contact with the intermediate medium 11 only when the roller 15 and the silicone rubber roller 14 are pressed with each other.

In the image printing operation carried out by laying the color layers 8, 9 and 10 on top of the dyeing layer 7 of the intermediate medium 11, it is desirable to provide a roller 24 to ensure that the image-forming layer transfer medium 3 and the intermediate medium 11 travel together in an overlapped manner. In FIG. 1 the roller 24 moves together with the printing head 1, thereby performing a role of forcibly overlapping the image-forming layer transfer medium 3 with the intermediate medium 11. With this arrangement, the image-forming layer transfer medium 3 is prevented from being separated from the intermediate medium 11 immediately after finishing a printing operation. Thus the dyeing layer 7 is stably held on the intermediate medium 11, thereby preventing the dyeing layer 7 from unwantedly returning onto the image-forming layer transfer medium 3 after finishing printing operation. The reason is explained below in more detail. The color layers 8. 9 and 10 (or both the color layers 8, 9, 10 and the dyeing layer 7) are in a thermally melting (or thermally softening) condition during the image printing operation. Therefore, the dyeing layer 7 and the color layers 8, 9 and 10 easily cause a thermal melting. Furthermore, as bonding strength between the intermediate medium 11 and the dyeing layer 7 is not so large, it is necessary to provide a cooling distance for overcoming undesirable thermal melting after finishing the printing operation, so as to prevent the dyeing layer 7 from being transferred onto the color layers 8, 9 and 10 when the image-forming layer transfer medium 3 is separated from the intermediate medium 11.

It is desirable to provide a sufficient clearance between the heating roller 15 (together with the silicone rubber roller 14) and the roller 17. Because, in the transfer operation of the laminate 28 from the intermediate medium to the image-receiving medium 12, after applying heat and pressure processing between the silicone rubber roller 14 and the heating roller 15, the dye anti-diffusion layer 27 can be sufficiently cooled down below the softening temperature (or the glass transition point). In other words, there is provided a cooling distance. Thus, it is assured that the dye anti-diffusion layer 27 is easily transferred onto the image-receiving medium 12. The dye anti-diffusion layer 27 is in a thermally melting (or thermally softening) condition immediately after finishing the heat and pressure processing; hence, a strong bonding force acts between the dye anti-diffusion layer 27 and the intermediate medium 11. This is why a sufficient cooling distance above-described is provided to weaken the bonding strength between the dye anti-diffusion layer 27 and the intermediate medium 11.

Meanwhile, the distance between the heating roller 15 and the roller 17 can be shortened taking account of properties of the surface of the intermediate medium 11, such as releasability, adhesiveness, surface roughness, rubber-elasticity or combination of these properties. Furthermore, the silicone rubber roller 14 and the heating roller 15 can be placed at the position where the rollers 16 and 17 are placed. Thus, the laminate 28 can be transferred onto the image-receiving medium 12 immediately after it passed through the clearance between the silicone rubber roller 14 and the heating roller 15 together with the image-receiving medium 12, or before it is cooled down.

One of rollers supporting the intermediate medium 11 can be replaced with a regulating roller which prevents the intermediate medium 11 from snaking. For example, the roller 18 can be an anti-snaking roller, such as a drum type roller and a solenoid-equipped position adjusting roller. Moreover, it is possible to replace one of rollers supporting the intermediate medium 11 with a tension roller for adjusting a tension given to a film of the intermediate medium 11. For example, the roller 19 can be a tension roller. Or, any one of the rollers 17, 18 and 19 or a newly added roller can be an anti-snaking roller or a tension roller. Furthermore, one roller may act as both an anti-snaking roller and a tension roller.

The embodiment of FIG. 1 shows a combination of the heating roller 15 and the silicone rubber roller 14 as a means for giving heat and/or pressure on the intermediate medium 11 and the image-receiving medium 12; however, the means for giving heat and/or pressure is not limited to this combination. The silicone rubber roller 14 can be a heating silicone rubber roller. The one disclosed in the Japanese Patent Application No. HEI 4-196707/1992 can be applied to the present invention. A detection mark can be provided on any one of the image-forming layer transfer medium 3, the intermediate medium 11 and the image-receiving medium 12 as occasion demands, together with a position sensor disposed at a face-to-face position to the detection mark. A temperature sensor for the heating roller, a temperature controller and others disclosed in the Japanese Patent Application No. HEI 4-196707/1992 can be also applied to the present invention.

The printing head 1 is, for example, a thermal head, an electrical head, or an optical head, having a capability of forming image into the dyeing layer 7 on the intermediate medium 11 by sublimating or diffusing the dyestuff of the color layers 7, 8, 9 in the transfer medium 3 to the dyeing layer 7 on the intermediate medium 11, or the one having a capability of transferring the dyeing layer 7 or the like from the image-forming layer transfer medium 3 to the intermediate medium 11, although type or details of the printing head 1 is not specifically limited.

The same means can be used as the means for transferring the dye anti-diffusion layer 27, the dyeing layer 7 or the laminate 28 from the image-forming layer transfer medium 3 to the intermediate medium 11, or the means for transferring the laminate from the intermediate medium 11 to the image-receiving medium 12.

Figure 2:
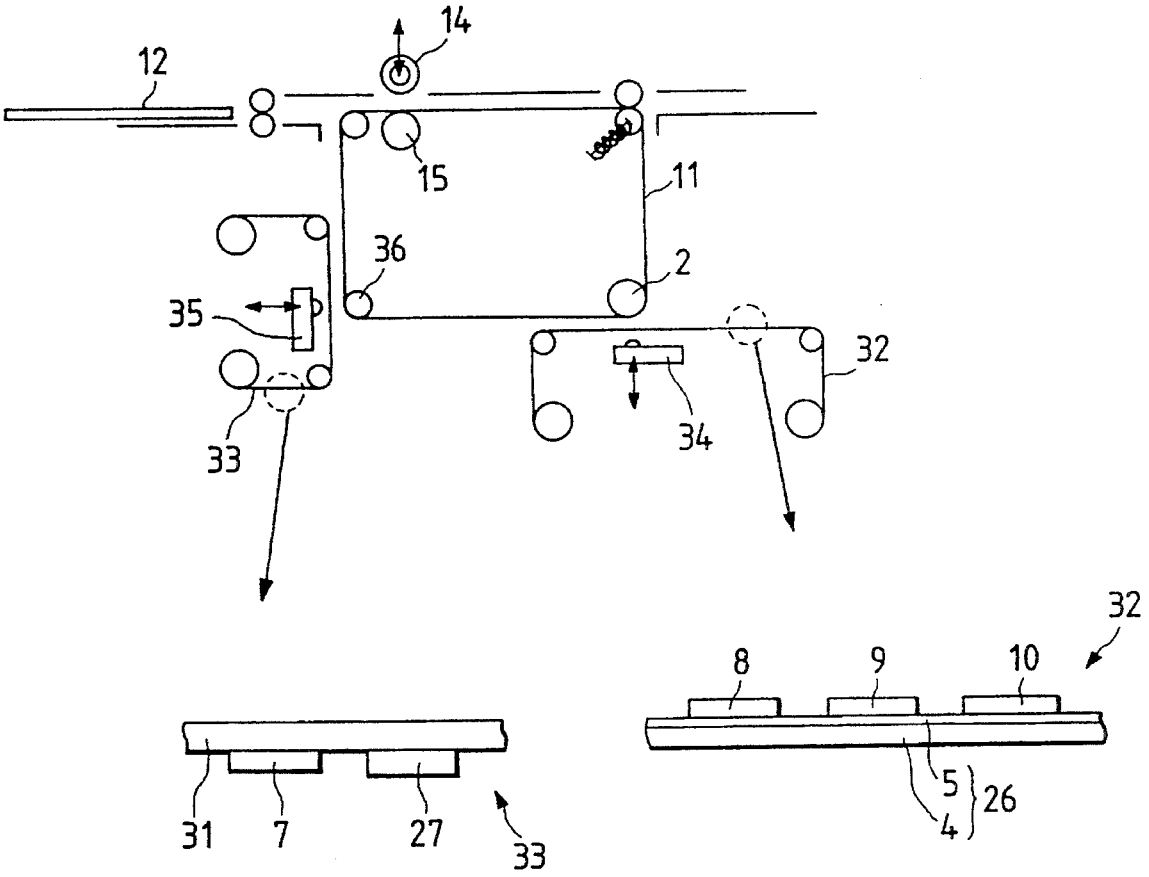

FIG. 2 is a schematic view showing a principle of the printing method in accordance with another preferred embodiment of the present invention. In FIG. 2, there are provided two transfer media, a dye transfer medium 32 and an image-forming layer transfer medium 33. Although FIG. 2 shows two printing heads (34 and 35), it is possible to provide only one printing head, for example the printing head 34, around which the image-forming layer transfer medium 33 and the dye transfer medium 32 will be disposed to commonly use the printing head 34, thereby realizing the printing process of the present invention using a single printing head.

The dye transfer medium 32 comprises a support 26 on which yellow, magenta and cyan color layers 8, 9 and 10 are sequentially disposed along a surface thereof. The image-receiving layer transfer medium 33 comprises a support 31 on which a dyeing layer 7 and a dye anti-diffusion layer 27 are sequentially disposed along a surface thereof. (Refer to an enlarged cross-sectional view of the transfer media) In the same manner as the embodiment of FIG. 1, the supports 28 and 31 have a back coat layer formed on a surface brought into contact with a thermal head (although FIG. 2 omits such a back coat layer).

First of all, the printing head 35 shown in the left of the drawing is pushed toward the platen 38 to cause the intermediate medium 11 and the image-forming layer transfer medium 33 to travel together in the same direction (For example, the intermediate medium 11 causes a rotation in the clockwise direction), thereby thermally transferring the dye anti-diffusion layer 27 from the image-forming layer transfer medium 33 to the intermediate medium 11 by means of the printing head 35, and forming the dye anti-diffusion layer 27 on the intermediate medium 11.

Next, the dye anti-diffusion layer 27 on the intermediate medium 11 is moved just on or close to the platen 36. Then, the dyeing layer 7 of the image-forming layer transfer medium 33 is laid on top of the dye anti-diffusion layer 27 to cause a similar thermal transition by means of the printing head 35. Thus, a laminate consisting of the dye anti-diffusion layer 27 and the dyeing layer 7 is formed on the intermediate medium 11.

Next, positions of the intermediate medium 11 and the dye transfer medium 32 are adjusted in such a manner that the yellow color layer 8 is just laid on top of the dyeing layer 7 of the laminate on the intermediate medium 11. Then the thermal transfer printing operation for forming yellow image into the dyeing layer 7 is carried out using the printing head 34 in the same manner as the embodiment of FIG. 1. Magenta and cyan images are similarly formed in the dying layer 7. Thereafter, the image-receiving medium 12 and the intermediate medium 11 pass through the paired silicone rubber roller 14 and heating roller 15 pressed with each other, in order to transfer the laminate of the dye anti-diffusion layer 27 and the dyeing layer 7 from the intermediate medium 11 onto the image-receiving medium 12, thereby forming image on the image-receiving medium 12.

Figure 3:
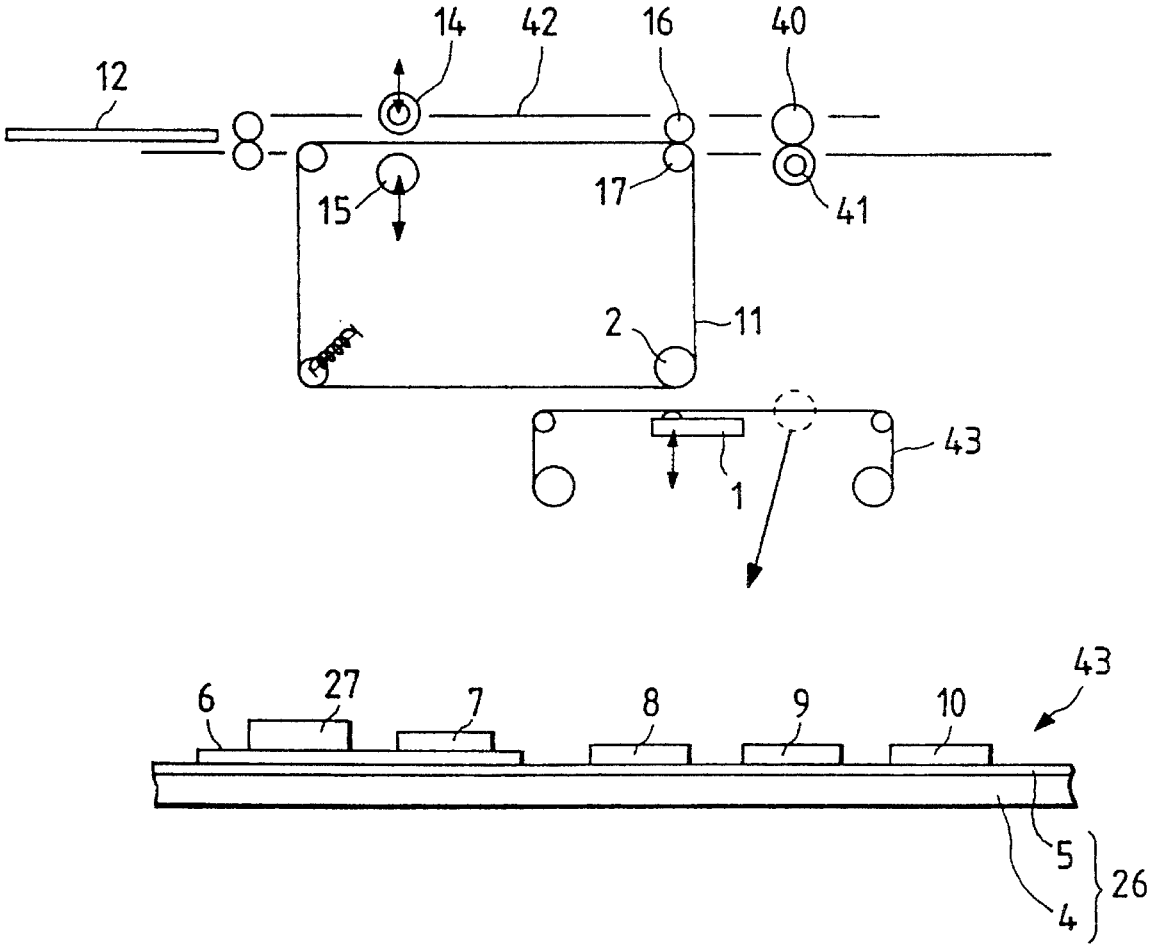

FIG. 3 is a schematic view showing a principle of the printing method in accordance with still another preferred embodiment of the present invention. FIG. 3 is characterized by a printing method of executing a fixing treatment applied to the dyeing layer and the dye anti-diffusion layer on the image-receiving medium, succeeding the printing method explained with reference to FIGS. 1 and 2.

An image-forming layer transfer medium 43, shown in FIG. 3 as a typical example, comprises a support 26, releasing layers 6, sequential laminates 28 and color layers. The support 26 consists of a polymeric film 4 and an anchor coat layer 5 formed on the polymeric film 4. A dye anti-diffusion layer 27 and a dyeing layer 7 are respectively formed on the support 26 via the releasing layer 6. A yellow color layer 8, a magenta color layer 9 and a cyan color layer 10 are sequentially disposed along a surface on the anchor coat layer 5 (Refer to an enlarged cross-sectional view of the image-forming layer transfer medium). In the same manner as the embodiment of FIGS. 2 and 3, the support 26 has a back coat layer formed on a surface brought into contact with a thermal head (although FIG. 3 omits such a back coat layer).

First, the dye anti-diffusion layer 27 of the image-forming layer transfer medium 43 is transferred onto the intermediate medium 11 by using heat and/or pressure by means of the printing head 1. Next, the dyeing layer 7 is transferred onto the dye anti-diffusion layer 27 formed on the intermediate medium 11, thus forming a laminate of the dye anti-diffusion layer 27 and the dyeing layer 7 on the intermediate medium 11. Subsequently, each dye of the color layers 8, 9 and 10 of the image-forming layer transfer medium 43 is successively transferred into the dyeing layer 7 of the laminate on the intermediate medium 11 in the same manner as in FIG. 1, thus accomplishing printing of color images.

After finishing the image printing operation, the dyeing layer 7 of the laminate on the intermediate medium 11 is overlapped with the image-receiving medium 12. Thereafter the intermediate medium 11 and the image-receiving medium 12 pass through the paired silicone rubber roller 14 and heating roller 15, then pass through the paired rollers 16 and 17 in the same manner as in the embodiment of FIG. 1, thereby transferring the laminate from the intermediate medium 11 to the image-receiving medium 12. Subsequently, the image-receiving medium 12 further passes through a pair of a metallic roller 40 and a heating silicone rubber roller 41 pressed with each other, thus fixing the laminate on the image-receiving medium 12. When the image-receiving medium 12 is porous like a plain paper, the laminate is pressed (or thermally pressed) into fibers. Accordingly, glossiness of the region where the laminate exists is remarkably lowered to a level almost the same as that of other region of the plain paper. Thus, it becomes possible to realize a fixing image having no virtual unevenness of glossiness. The glossiness desirable would be less than 20 and preferably less than 10.

The metallic roller 40 and the heating silicone rubber roller 41, mutually pressed with each other in the condition shown in FIG. 3, at least one of them can be a movable type which is/are brought into contact with an opponent roller only when the fixing processing is required, like a mechanism of the silicone rubber roller 14 and the heat roller 15. The fixing processing disclosed in Japanese Patent Application No. HEI 4-196707/1992 can be applied to the present invention. For example, the heating silicone rubber roller 41 can be an endless type travelling on a heating section, or an endless type equipped with a resistance heating section.

Other embodiment of the printing method for obtaining print image having low glossiness will be explained below. In FIG. 1, the image-receiving medium 12 with the laminate attached thereon, which is once output into the tray 21, is again fed between the rollers 14 and 15 in such a manner the laminate faces to the silicone rubber roller 14 (i.e. a representative of an elastic roller). With this fixing operation, print image having low glossiness is obtained. In this case, it is preferable that the silicone rubber roller 14 is heated by the heating roller 15 or that the silicone rubber roller 14 is a heating silicone rubber roller accommodating a heater or the like.

Figure 4:
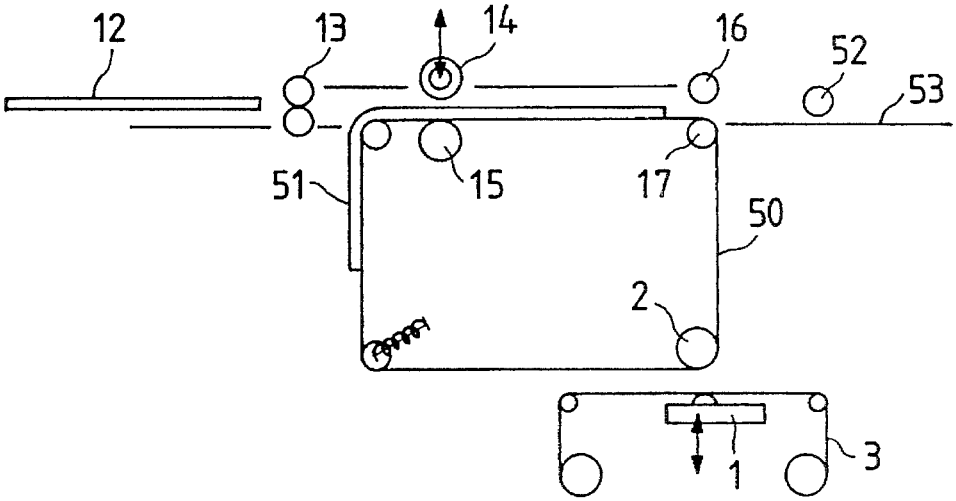

FIG. 4 is a schematic view showing a principle of the printing method in accordance with yet another preferred embodiment of the present invention. The image-forming layer transfer medium 3 is the same as the one disclosed in the first embodiment. An intermediate medium 50 has an elastic layer 51 formed thereon at least partly. The elastic layer 51 can has a surface treatment layer for facilitating transfer of the dye anti-diffusion layer and others onto the surface thereof.

First, the laminate 28 of the image-forming layer transfer medium 3 is transferred onto the elastic layer 51 by heat and/or pressure by means of the printing head 1. Subsequently, each dye of color layers 8, 9 and 10 of the image-forming layer transfer medium 3 is transferred into the dyeing layer 7 of the laminate formed on the elastic layer of the intermediate medium 50 in the same manner as the embodiment of FIG. 1, thereby accomplishing image printing operation of respective colors.

Next, a plain paper is used as the image-receiving medium 12 in the same manner as in the previous embodiments. The laminate consisting of the dye anti-diffusion layer and the dyeing layer is overlapped with the plain paper. The intermediate medium 50 and the plain paper integrated with each other pass through the paired rollers 14 and 15, so that the laminate is transferred and fixed on the plain paper, thus outputting the plain paper with low glossy image printed thereon into a tray 53. The laminate on the intermediate medium 50 is applied a fixing processing by the elastic layer 51 when it passes through the paired rollers 14 and 15 as well as transferred onto the plain paper. Therefore, the print image obtained on the plain paper has low glossiness. On the other hand, if high glossiness is required, it will be desirable to use a non-porous image-receiving medium such as a polymeric sheet or a coated paper including an art sheet.

Furthermore, the following printing method would be effective to obtain print image having low glossiness. In FIG. 4, the laminate of the image-forming layer transfer medium 3 is transferred onto the region other than the elastic layer 51. Each dye of the color layers 8, 9 and 10 of the image-forming layer transfer medium 3 is transferred into the dyeing layer of the laminate consisting of the dye anti-diffusion layer and the dying layer formed on the intermediate medium 50, thereby accomplishing image printing operation of respective colors. The intermediate medium 50 with the laminate thereon and the image-receiving medium 12 (e.g. a plain paper) integrated with each other pass through the paired rollers 14 and 15, so that the laminate is transferred from the intermediate medium 50 onto the image-receiving medium 12, thus outputting the image-receiving medium with laminate substance thereon into the tray 53.

Next, the plain paper with the laminate thereon is returned on the intermediate medium 50 by means of a driving roller 52. Keeping a condition that the elastic layer 51 of the intermediate medium 50 is overlapped with the laminate on the plain paper, the intermediate medium 50 is rotated in the counterclockwise direction so that the plain paper and the intermediate medium 50 pass through the paired rollers 14 and 15. In this case, the elastic layer 51 acts to fix the laminate on the plain paper. Thus, print image having low glossiness is formed on the plain paper.

Figure 5:
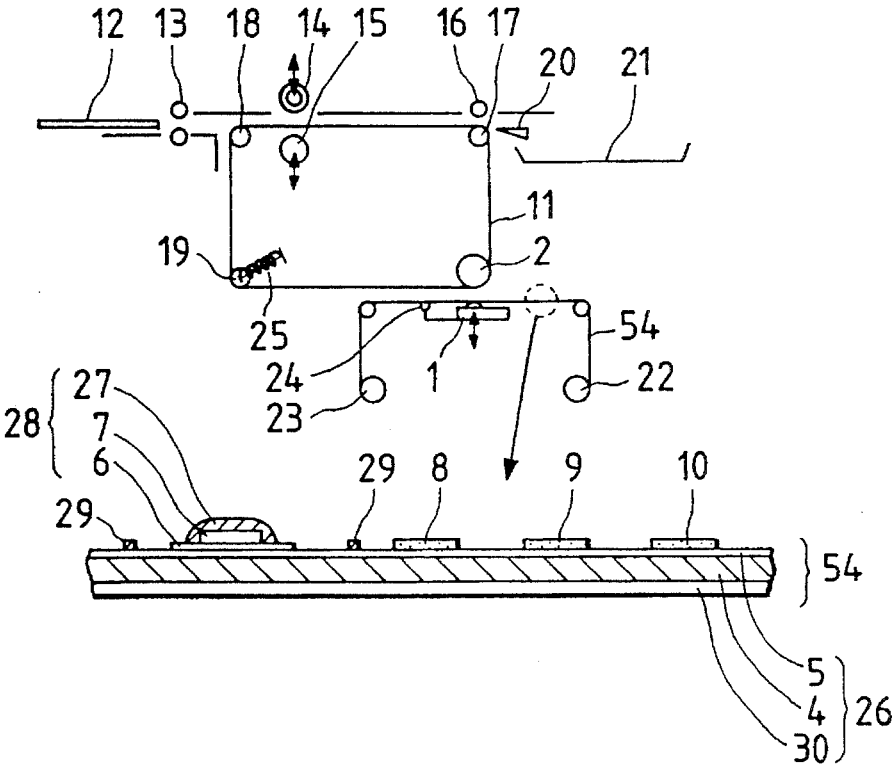

FIG. 5 is a schematic view showing a principle of the printing method in accordance with still further another preferred embodiment of the present invention. An image-forming layer transfer medium 54, shown in FIG. 5 as a typical example, comprises a support 26, releasing layers 6, sequential laminates 28, color layers and sensor marks. The support 26 consists of a polymeric film 4, an anchor coat layer 5 formed on the polymeric film 4 and a back coat layer 30 formed under the polymeric film 4. The laminate 28 consisting of a dyeing layer 7 and a dye anti-diffusion layer 27 is formed on the support 26 via the releasing layer 6. A yellow color layer 8, a magenta color layer 9 and a cyan color layer 10 are sequentially disposed along a surface on the support 26. (Refer to an enlarged cross-sectional view of the image-forming layer transfer medium 54.) Sensor marks 29 are formed on the support 26 to detect the laminate 28 and a head of sequential color layers, i.e. the yellow color layer 8.

Printing method of the embodiment of FIG. 5 is similar to that of the embodiment of FIG. 1, and therefore will be no more explained.

In the formation of the thermal transfer image into the dyeing layer of the laminate of the intermediate medium in each embodiment, and more particularly in the image formation into the dyeing layer of the laminate using a transfer medium having a plurality of different color layers such as yellow, magenta and cyan color layers, a color image is formed into the dyeing layer of one laminate using a plurality of color layers. Or it will be preferable to print each color image independently into the dyeing layer of its corresponding laminate on the intermediate medium in accordance with each color layer, in a case where the image-forming layer transfer medium has a plurality of separated laminates on the support thereof. Especially, in the latter case, image of plural colors or full color will be formed by transferring the laminate of each color onto the image-receiving medium in an overlapped manner.

Although the above-explained embodiments show the laminate 28 of the image-forming layer transfer medium as consisting of only the dyeing layer 7 and the dye anti-diffusion layer 27, the printing method of the present invention can be equally realized by using a laminate consisting of a dyeing layer, a protecting layer and a dye anti-diffusion layer sequentially laminated in this order or a laminate consisting of a dyeing layer, a dye anti-diffusion layer and a protecting layer sequentially laminated in this order.

Furthermore, the image-forming layer transfer medium of the present invention is not limited to the one disclosed in the above embodiments, such as the one having the support 26 on which the laminate 28 and the color layers 8, 9 and 10 are formed. For example, the transfer medium can include other layers in addition to each layer of the dyeing layer and the dye anti-diffusion layer and/or color layers, or include other layers in addition to each layer of the dyeing layer, the dye anti-diffusion layer, the protecting layer and/or color layers.

Moreover, in a case where usage of a plurality of transfer media is allowed, it will be possible to use a transfer medium only having various layers other than the layers above explained together with a transfer medium loading a dyeing layer, a dye anti-diffusion layer, a protecting layer and/or color layers. As one example, a transfer medium for other various layers may include a support with a polymeric substance layer, an ultraviolet ray absorption agent layer or an over coat layer formed thereon spaced with each other or piled up sequentially. These layers can be used or transferred as occasion demands in each step of the printing process (for example, before and after the laminate is formed on the intermediate medium, after image is printed in the dyeing layer of the laminate, or after the laminate is transferred onto the image-receiving medium, etc.). Still further, a transfer medium may includes a heat-sensitive transferring pigment ink layer as one of various layers. In the transfer operation of, for example, the laminate from the transfer medium to the intermediate medium, the laminate is peeled off from the support at an interface between the laminate and the support or an interface between the releasing layer and the laminate. This is the same in a case where a dyeing layer, a dye anti-diffusion layer, a protecting layer or other layers are separately formed on the support or the releasing layer. The releasing layer may contain adhesive agent.

In a case where the image-forming layer transfer medium has a support on which a dyeing layer, a protecting layer and a dye anti-diffusion layer are formed at different positions thereon in the same manner as explained with reference to FIG. 3 which shows the image-forming layer transfer medium having a support on which a dyeing layer and a dye anti-diffusion layer are formed at different positions, it becomes possible to form a laminate of the dye anti-diffusion layer, the protecting layer and the dyeing layer sequentially laminated in this manner, or a laminate of the protecting layer, the dye anti-diffusion layer and the dyeing layer sequentially laminated in this manner, on the intermediate medium by successively transferring the dye anti-diffusion layer, the protecting layer and the dyeing layer, or by successively transferring the dyeing layer, the dye anti-diffusion layer and the protecting layer.

In the same manner, in a case where the image-forming layer transfer medium has a support on which a sequential substance consisting of a dyeing layer and a protecting layer is formed separately from a dye anti-diffusion layer, or in a case where the image-forming layer transfer medium has a support on which a sequential substance consisting of a dyeing layer and a dye anti-diffusion layer is formed separately from a protecting layer, it is possible to form a sequential laminate of the dye anti-diffusion layer, the protecting layer and the dyeing layer or a sequential laminate of the protecting layer, the dye anti-diffusion layer and the dyeing layer on the intermediate medium.

The intermediate medium 11, shown as an endless belt in the embodiments, can be any other type such as a drum or a film. An example of the intermediate medium would be, for example, various polymeric films, coated polymeric films, various conductive films or drums with surfaces coated by the following materials. The various polymeric films would be, for example, polyolefine group, polyamide group, polyester group, polyimide group, polyether group, cellulose group, polyparabanic acid group, polyoxadiazole group, polystyrene group, and fluorine-containing group films. Particularly, polyethylene terephthalate, polyethylene naphthalate, aromatic polyamide, triacetyl cellulose, polyparabanic acid, polysulfone, and polyimide films would be suitable.

Furthermore, the following materials would be desirable as intermediate medium. Or, the intermediate medium would be a film or a drum on the surface of which a hard substance of acrylate resin is formed. An example of the acrylate resin would be, for example, polyester acrylate resin, urethane acrylate resin (e.g. polyester urethane acrylate resin, polyether urethane acrylate resin etc.), epoxy acrylate resin, spiroacetal resin, silicone acrylate resin etc.

The intermediate medium may has a surface containing various adhesive agents, various particulates (super particulates), releasing agents, or antistatic agents. Composite amorphous silica, titanium oxide, calcium carbonate, alumina, talc, carbon black or the like would be recommendable as various particulates. Various coupling agents, such as silane coupling agent, would be used in addition to various particulates. As a releasing agent, a material explained with reference to the following releasing layer 6 will be used. Roughing of the surface by use of particulates and/or addition of adhesive agents increases the area of the surface of the intermediate medium, and addition of releasing agents enable to control the surface characteristics.

The elastic layer 51 is an elastic member showing rubber hardness less than 90° at the atmospheric temperature less than 100° C. (e.g. a room temperature) or a material having glass transition temperature less than 60° C.

The elastic layer 51 would be, for example, a fluoride rubber such as a copolymer of vinylidene fluoride and trifluoride ethylene chloride, a copolymer of vinylidene fluoride and hexafluoride propylene, a copolymer of vinylidene fluoride and hexafluoride propylene and tetrafluoride ethylene, and a copolymer of tetrafluoride ethylene and propylene, a silicone rubber of hardening type, a fluorine-containing silicone rubber, an urethane rubber, a chloroprene rubber, an isoprene rubber, a butyl rubber, a butadiene rubber, a nitryl-butadien rubber, an acrylic rubber, an epichlorohydrine rubber, a styrene-butadien rubber, a propylene oxide rubber, an ethylene-vinyl acetate rubber, an ethylene-acrylic rubber, a nitryl hydride rubber, a polysulfide rubber or a natural rubber. The elastic member would be, for example, various thermoplastic elastomer of urethane, polyester, olefin, styrene, polyamide, vinyl chloride, fluorine-containing groups, or a blowing agent. Furthermore, the elastic member would be made from emulsion of various urethane of polyether group and polyester group, epoxy, copolymer of styrene and butadien, copolymer of acrylonitrile-butadien, acrylic, silicone, fluorine-containing group or the like. The elastic member is not related to bridge structure. The elastic member may contain various particulates such as carbon, white carbon, red oxide etc., or colorant such as pigment, or releasing agent.

FIGS. 6 through 37 are cross-sectional views schematically showing image-forming layer transfer media in accordance with the preferred embodiments of the present invention.

The image-forming layer transfer medium includes a support on which a sequential substance consisting of at least a dyeing layer and a dye anti-diffusion layer is formed, or a support on which a dyeing layer and a dye anti-diffusion layer are formed separately from each other. Or the image-forming layer transfer medium can be divided into a plurality of transfer media including a transfer medium comprising a support on which a dyeing layer is formed and another transfer medium comprising a support on which a die anti-diffusion layer is formed. Otherwise, the image-forming layer transfer medium includes a support on which at least a dyeing layer and a protecting layer and a dye anti-diffusion layer.

In each of the above-described image-forming layer transfer medium, a releasing layer can be interposed between the support and the dyeing layer, and/or between the support and the protecting layer, and/or between the support and the dye anti-diffusion layer. Furthermore, each of the above-described image-forming layer transfer medium (or at least one transfer medium when the image-forming layer transfer medium consists of a plurality of transfer media) comprises at least one color layer on the support.

An example of the image-forming layer transfer medium comprising at least a dyeing layer and a protecting layer and a die anti-diffusion layer formed on its support would be as follows.

A dyeing layer, a protecting layer and a die anti-diffusion layer can be provided at different positions on a support.

or, a sequential laminate consisting of a dyeing layer and a protecting layer can be provided at a position different from that of a die anti-diffusion layer on the support.

Or, a sequential laminate consisting of a dyeing layer and a die anti-diffusion layer can be provided at a position different from that of a protecting layer on a support.

Or, a sequential laminate consisting of a dyeing layer, a protecting layer and a die anti-diffusion layer piled up in this order can be provided on a support.

Or, a sequential laminate consisting of a dyeing layer, a die anti-diffusion layer and a protecting layer piled up in this order can be provided on a support.

Although not shown in the drawings, the image-forming layer transfer medium can be divided into three transfer media, a transfer medium having a dyeing layer on its support, a transfer medium having a protecting layer on its support, and a transfer medium having a dye anti-diffusion layer on its support.

Or, the image-forming layer transfer medium can be divided into two transfer media, a transfer medium having a sequential laminate consisting of a dyeing layer and a protecting layer formed on its support and a transfer medium having a dye anti-diffusion layer on its support.

Or, the image-forming layer transfer medium can be divided into two transfer media, a transfer medium having a sequential laminate consisting of a dyeing layer and a dye anti-diffusion layer formed on its support and a transfer medium having a protecting layer on its support. When the image-forming layer transfer medium is constituted by a plurality of separated transfer media, at least one of plural transfer media can further include at least one color layer provided on its support.

Figure 6:
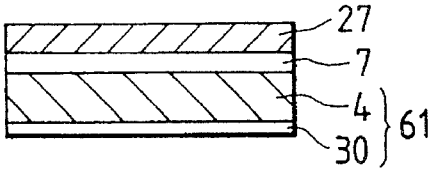
FIGS. 6 through 37 are cross-sectional views schematically showing image-forming layer transfer media in accordance with the preferred embodiments of the present invention.

FIG. 6 shows an image-forming layer transfer medium comprising a support 61 consisting of a polymeric film 4 with a back coat layer 30, a dyeing layer 7 formed on the support 61, and a dye anti-diffusion layer 27 formed on the dyeing layer 7 which are sequentially piled up on the support 61.

Figure 7:
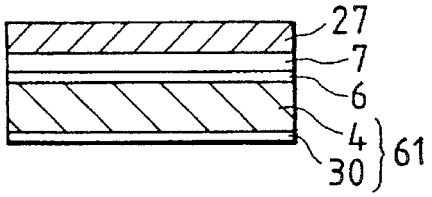
Figure 8:
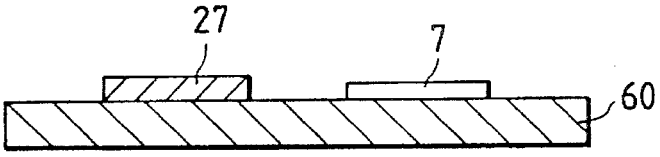

FIG. 7 shows an image-forming layer transfer medium comprising a support 81 identical with that of FIG. 8, a releasing layer 8 formed on the support 81, a dyeing layer 7 formed on the releasing layer 8, and a dye anti-diffusion layer 27 formed on the dyeing layer 7 which are sequentially piled up on the support 61.

FIG. 8 shows an image-forming layer transfer medium comprising a support 60 on which a dye anti-diffusion layer 27 and a dyeing layer 7 are formed at different positions.

Figure 9:
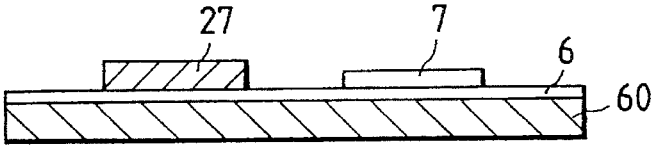

FIG. 9 shows an image-forming layer transfer medium comprising a support 60, a releasing layer 6 formed on the support 60, a dye anti-diffusion layer 27 and a dyeing layer 7 formed at different positions on the releasing layer 6.

Figure 10:
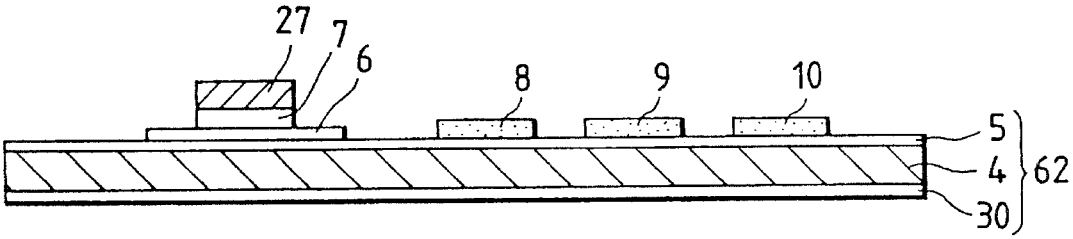

FIG. 10 shows an image-forming layer transfer medium comprising a support 62 consisting of a polymeric film 4 with one surface on which an anchor coat layer 5 is formed and an opposite surface on which a back coat layer 30 is formed, a sequential laminate consisting of a releasing layer 6, a dyeing layer 7 and a die anti-diffusion layer 27 sequentially piled up on the anchor coat layer 5, a yellow color layer 8, a magenta color layer 9, and a cyan color layer 10 provided on the anchor coat layer 5 separately from each other at positions different from that of the sequential laminate.

Figure 11:
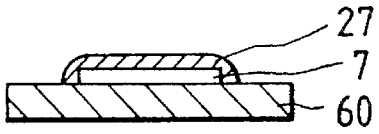

FIG. 11 shows an image-forming layer transfer medium comprising a support 60 on which a dyeing layer 7 and a dye anti-diffusion layer 27 are sequentially piled up, wherein the area of the die anti-diffusion layer 27 is larger than that of the dyeing layer 7.

Figure 12:
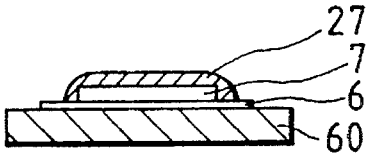
Figure 13:
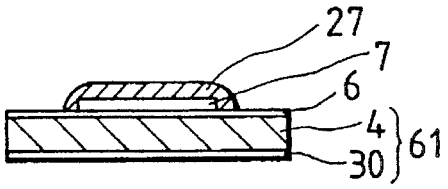

FIG. 12 shows an image-forming layer transfer medium comprising a support 80, a releasing layer 8 formed on the support 80, a dyeing layer 7 and a dye anti-diffusion layer 27 sequentially piled up on the releasing layer 8, wherein the area of the die anti-diffusion layer 27 is larger than that of the dyeing layer 7.

FIG. 1B shows an image-forming layer transfer medium comprising a support 81 consisting of a polymeric film 4 with a back coat layer 30, a releasing layer 8 formed on the polymeric film 4, a dyeing layer 7 and a dye anti-diffusion layer 27 sequentially piled up on the releasing layer 8 in the same manner as in FIG. 12.

Figure 14:
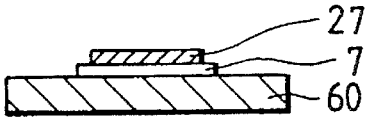

FIG. 14 shows an image-forming layer transfer medium comprising a support 80 on which a dyeing layer 7 and a dye anti-diffusion layer 27 are sequentially piled up, wherein the area of the dyeing layer 7 is larger than that of the die anti-diffusion layer 27.

Figure 15:
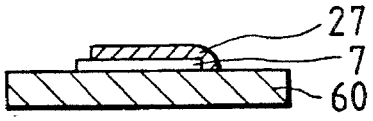

FIG. 15 shows an image-forming layer transfer medium comprising a support 60 on which a dyeing layer 7 and a dye anti-diffusion layer 27 are sequentially piled up, wherein a part of the dyeing layer 7 is bared or uncovered by the dye anti-diffusion layer 27.

Figure 16:
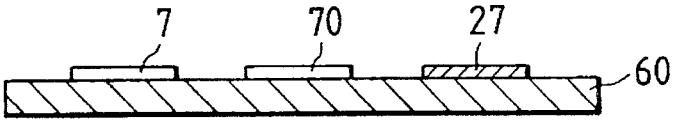

FIG. 16 shows an image-forming layer transfer medium comprising a support 60 on which a dyeing layer 7, a dye anti-diffusion layer 27, and a protecting layer 70 are separately provided.

Figure 17:
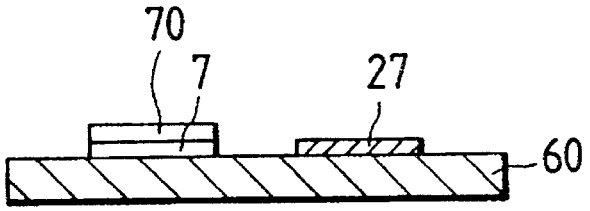

FIG. 17 shows an image-forming layer transfer medium comprising a support 60 on which a sequentially piled up substance of a dyeing layer 7 and a protecting layer 70 is formed separately from a dye anti-diffusion layer 27.

Figure 18:
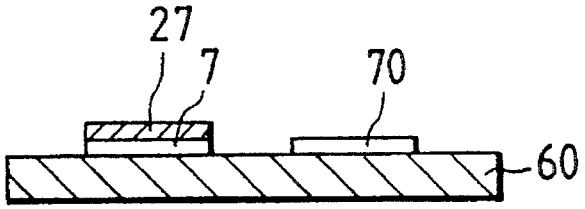

FIG. 18 shows an image-forming layer transfer medium comprising a support 60 on which a sequentially piled up substance of a dyeing layer 7 and a dye anti-diffusion layer 27 is formed separately from a protecting layer 70.

Figure 19:
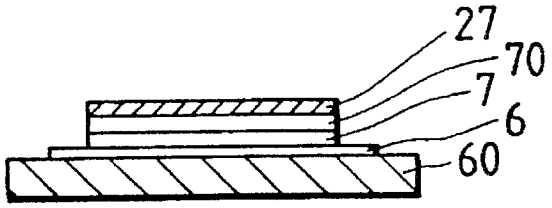

FIG. 19 shows an image-forming layer transfer medium comprising a support 60, a releasing layer 6 formed on the support 60, a dyeing layer 7, a protecting layer 70 and a dye anti-diffusion layer 27 sequentially piled up on the releasing layer 6.

Figure 20:
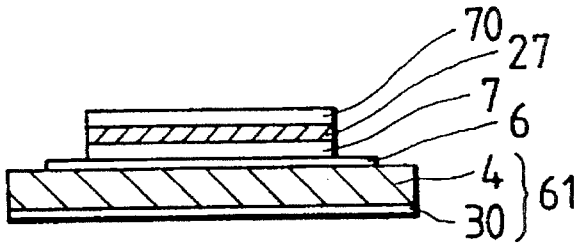

FIG. 20 shows an image-forming layer transfer medium comprising a support 61 consisting of a polymeric film 4 with a back coat layer 30, a releasing layer 6 formed on the polymeric film 4, a dyeing layer 7, a dye anti-diffusion layer 27 and a protecting layer 70 sequentially piled up on the releasing layer 6.

Figure 21:
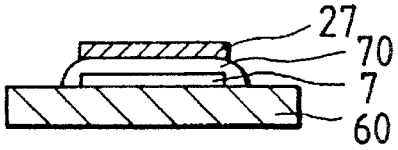

FIG. 21 shows an image-forming layer transfer medium comprising a support 60 on which a dyeing layer 7, a protecting layer 70 and a dye anti-diffusion layer 27 are sequentially piled up, wherein the area of the protecting layer 70 is larger than that of the dyeing layer 7 or that of the dye anti-diffusion layer 27.

Figure 22:
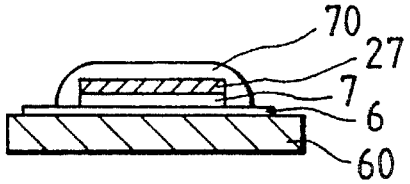

FIG. 22 shows an image-forming layer transfer medium comprising a support 60, a releasing layer 6 formed on the support 60, a dyeing layer 7, a dye anti-diffusion layer 27 and a protecting layer 70 sequentially piled up on the releasing layer 6, wherein the area of the protecting layer 70 is larger than that of the dyeing layer 7 or that of the dye anti-diffusion layer 27.

Figure 23:
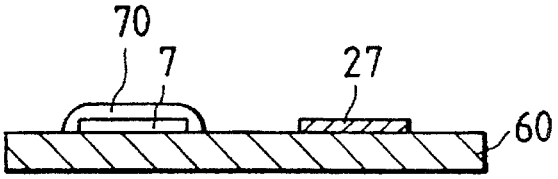

FIG. 23 shows an image-forming layer transfer medium comprising a support 60 on which a sequential laminate of a dyeing layer 7 and a protecting layer 70 is formed separately from a dye anti-diffusion layer 27, wherein the area of the protecting layer 70 is larger than that of the dyeing layer 7.

Figure 24:
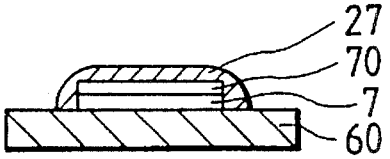
Figure 25:
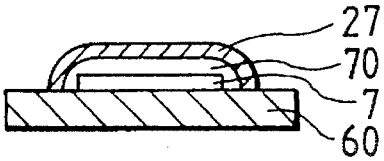

FIGS. 24 and 25 show image-forming layer transfer media comprising a support 60 on which a dyeing layer 7, a protecting layer 70 and a dye anti-diffusion layer 27 are sequentially piled up, wherein the area of the die anti-diffusion layer 27 is larger than that of the dyeing layer 7 or that of the protecting layer 70.

Figure 26:
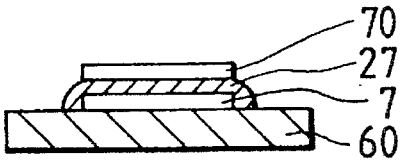

FIG. 26 shows an image-forming layer transfer medium comprising a support 60 on which a dyeing layer 7, a dye anti-diffusion layer 27 and a protecting layer 70 are sequentially piled up, wherein the area of the die anti-diffusion layer 27 is larger than that of the dyeing layer 7 or that of the protecting layer 70.

Figure 27:
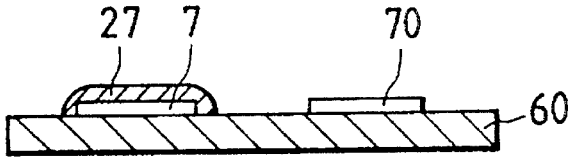

FIG. 27 shows an image-forming layer transfer medium comprising a support 60 on which a sequential laminate of a dyeing layer 7 and a dye anti-diffusion layer 27 is formed separately from a protecting layer 70, wherein the area of the die anti-diffusion layer 27 is larger than that of the dyeing layer 7.

Figure 28:
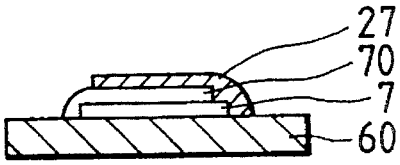

FIG. 28 shows an image-forming layer transfer medium comprising a support 60 on which a dyeing layer 7, a protecting layer 70 and a dye anti-diffusion layer 27 are sequentially piled up, wherein the dyeing layer 7 is covered by both the protecting layer 70 and the dye anti-diffusion layer 27.

Figure 29:
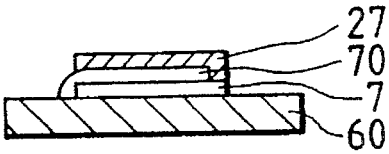

FIG. 29 shows an image-forming layer transfer medium comprising a support 60 on which a dyeing layer 7, a protecting layer 70 and a dye anti-diffusion layer 27 are sequentially piled up, wherein a part of the protecting layer 70 protrudes farther than the dyeing layer 7 and the dye anti-diffusion layer 27.

Figure 30:
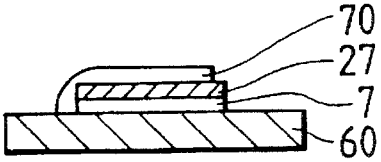

FIG. 30 shows an image-forming layer transfer medium comprising a support 60 on which a dyeing layer 7, a dye anti-diffusion layer 27 and a protecting layer 70 are sequentially piled up, wherein a part of the protecting layer 70 protrudes farther than the dyeing layer 7 and the dye anti-diffusion layer 27.

Figure 31:
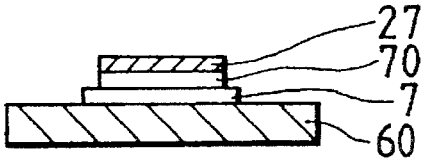
Figure 32:
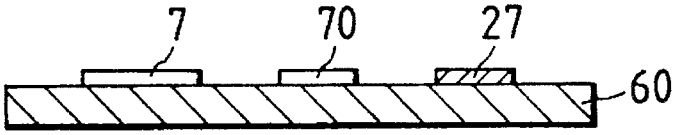

FIG. 31 shows an image-forming layer transfer medium comprising a support 60 on which a dyeing layer 7, a protecting layer 70 and a dye anti-diffusion layer 27 are sequentially piled up, wherein the area of the dyeing layer 7 is larger than that of the protecting layer 70 or that of the dye anti-diffusion layer FIG. 32 shows an image-forming layer transfer medium comprising a support 60 on which a dyeing layer 7, a protecting layer 70 and a dye anti-diffusion layer 27 are formed separately from each other, wherein the area of the dyeing layer 7 is larger than that of the protecting layer 70 or that of the dye anti-diffusion layer 27.

Figure 33:
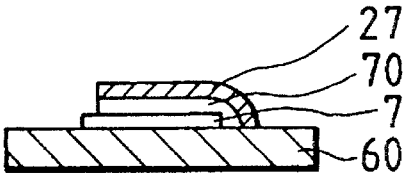

FIG. 33 shows an image-forming layer transfer medium comprising a support 60 on which a dyeing layer 7, a protecting layer 70 and a dye anti-diffusion layer 27 are sequentially piled up, wherein a part of the dyeing layer 7 protrudes farther than the protecting layer 70 and the dye anti-diffusion layer 27.

Figure 34:
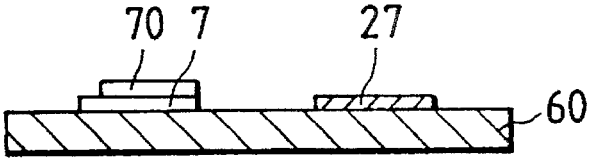

FIG. 34 shows an image-forming layer transfer medium comprising a support 60 on which a sequential laminate of a dyeing layer 7 and a protecting layer 70 is formed separately from a dye anti-diffusion layer 27, wherein a part of the dyeing layer 7 protrudes farther than the protecting layer 70.

Figure 35:
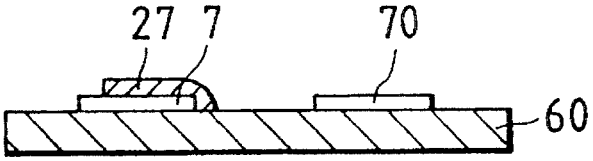

FIG. 35 shows an image-forming layer transfer medium comprising a support 60 on which a sequential laminate of a dyeing layer 7 and a dye anti-diffusion layer 27 is formed separately from a protecting layer 70, wherein a part of the dyeing layer 7 protrudes farther than the dye anti-diffusion layer 27.

Figure 36:
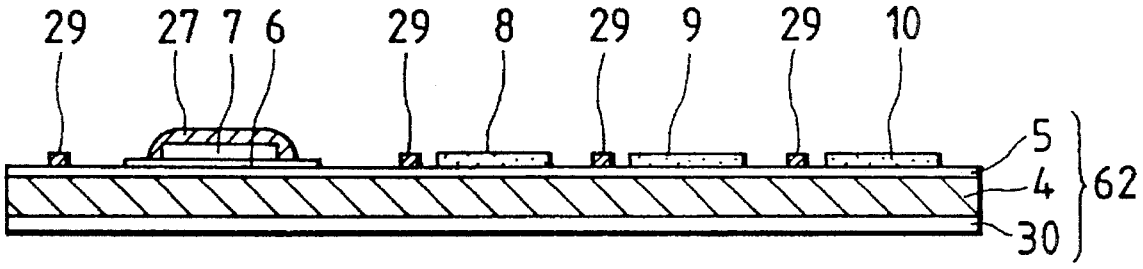

FIG. 36 shows an image-forming layer transfer medium comprising a support 62 consisting of a polymeric film 4 with one surface a back coat layer 30 is formed and an opposite surface on which an anchor coat layer 5 is formed, a sequential laminate consisting of a dyeing layer 7 and a die anti-diffusion layer 27 sequentially piled up on the anchor coat layer 5 via a releasing layer 6, a yellow color layer 8, a magenta color layer 9, and a cyan color layer 10 provided on the anchor coat layer 5 separately from each other at positions different from that of the sequential laminate, and sensor marks 29, . . . , 29 provided on the anchor coat layer 5 for detecting the position of each of the laminate or color layers.

Figure 37:
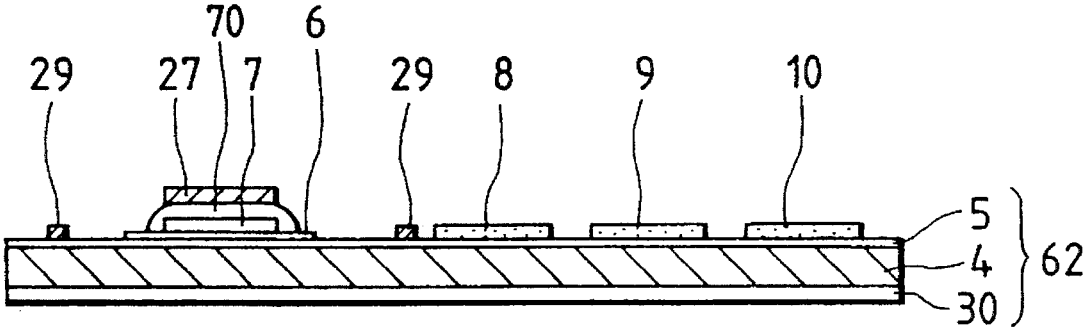

FIG. 37 shows an image-forming layer transfer medium comprising a support 62 identical with the one disclosed in FIG. 36, a sequential laminate consisting of a dyeing layer 7, a protecting layer 70 and a die anti-diffusion layer 27 sequentially piled up on the anchor coat layer 5 via a releasing layer 6, a yellow color layer 8, a magenta color layer 9, and a cyan color layer 10 provided on the anchor coat layer 5 separately from each other at positions different from that of the sequential laminate, and sensor marks 29 and 29 provided on the anchor coat layer 5 for detecting the position of the laminate or the position of the head of color layers, wherein the area of the protecting layer 70 is larger than that of the dyeing layer 7 or that of the dye anti-diffusion layer 27.

In the embodiments of FIGS. 6 through 37, if the area of each layer is not particularly set forth, the area of each layer can be the same or different.

It the embodiments of FIGS. 28, 31, 33 and 37, the uppermost layer can be the protecting layer 70. The dyeing layer, the protecting layer, or the dye anti-diffusion layer can have a multi-layer structure. A polymeric substance layer can be formed on the dyeing layer, or on the dye anti-diffusion layer, or the protecting layer, or on the support. It will be desirable that the dyeing layer, the protecting layer, the dye anti-diffusion layer, or the polymeric substance layer contains ultraviolet ray absorbing agent, light stabilizing agent, or antioxidant. The ultraviolet ray absorbing agent would be, for example, benzophenone group, diphenyl acrylate group, and benzotriazole group. The light stabilizing agent would be, for example, hindered amine group, and benzoate group. The antioxidant would be, for example, hindered phenolic compound.

Material used for the support of the transfer medium is not specially limited. For example, various polymeric films, coated polymeric films, various conductive films would be suitable. Various polymeric films include polyolefine group, polyamide group, polyester group, polyimide group, polyether group, cellulose group, polyparabanic acid group, polyoxadiazole group, polystyrene group, and fluorine-containing group films. Particularly, polyethylene terephthalate, polyethylene naphthalate, aromatic polyamide, triacetyl cellulose, polyparabanic acid, polysulfone, polypropylene, cellophane or polyethylene would be suitable.

A support, having at least one surface with a heat-resisting layer and/or a lubricating layer, would be preferable in view of improvement of heat durability or travelling stability relative to the printing head. A support, made of polymeric film or conductive film comprising a bonding layer (anchor coat layer) provided on a surface which is brought into contact with color layers containing sublimable (diffusible) dyestuff to prevent color layers from being peeled off from the film during the printing operation. A preferable conductive film would be, for example, a polymeric film containing various conductive particulates such as carbon black, metallic powder or the like, or a polymeric film with a conductive coating layer, or a polymeric film having a conductive deposition layer.

The dyeing layer 7 is formed by using polymeric material. The one disclosed in the Japanese Patent Application No. HEI 4-196707/1992 can be used in the present invention. A dyeing layer, made of polyvinyl acetal group resin, would be preferable.

The dye anti-diffusion layer 27 is formed by using polymeric substance, which would be a polymeric substance having a glass transition point (Tg) higher than that of the dyeing layer, a polymeric substance having a softening point higher than that of the dyeing layer, a resin having a remarkably low dyeing ability, or a material having thermal diffusion characteristics of dyestuff worse than that of the dyeing layer. A polymeric substance, having a glass transition point or a softening point approximately 20° C., preferably 30° C., higher than that of the dyeing layer, would be recommendable. The higher the glass transition point or the softening point, the better the capability of preventing dyestuff from diffusing. A preferable polymeric substance would be, for example, various thermoplastic resin, various hardening resins responsive to heat, light, electron beam etc. The polymeric substance disclosed in the Japanese Patent Application No. HEI 4-196707/1992 can be used in the present invention. The dye anti-diffusion layer may contain a fluorine-containing moisture curable resin, a siloxane-containing moisture curable resin, or various releasing agents or adhesive agents for the releasing layer disclosed below. A dye anti-diffusion layer, containing polyvinyl butyral and/or polyvinyl alcohol, would be recommendable.

The protecting layer 70 is formed by using polymeric substance. The polymeric substance used for the protecting layer would be, for example, various thermoplastic resins, various hardening resins responsive to heat, light, electron beam etc. The material for the dyeing layer or the polymeric substance layer disclosed in the Japanese Patent Application No. HEI 4-196707/1992 can be used in the present invention. When the dyeing layer is made of a resin having a low glass transition point or a low softening point, reserving the image-forming layer transfer medium in a wound condition at a higher temperature will encounter with difficulty. Therefore a protecting layer, made of a polymeric substance having a glass transition point or a softening point higher than that of the resin of the dyeing layer, would be recommendable. The protecting layer 70 can have a dyeing function as well as the dyeing layer 7, and also have a function of protecting dyestuff from diffusing as well as a dye anti-diffusion layer 27. The protecting layer may contain a fluorine moisture containing hardening resin, a siloxane moisture containing hardening resin, or various releasing agents or adhesive agents for the releasing layer disclosed below. A protecting, containing polyvinyl butyral and/or acetoacetalized polyvinyl alcohol, would be recommendable.

The releasing layer 6 is not particularly limited in material. The material disclosed in the Japanese Patent Application No. HEI 4-196707/1992 can be used in the present invention. A preferable combination would be, for example, various thermoplastic resins or various hardening resins responsive to heat, light and electron beam, or various reactive resins bridging by various bridging agent such as isocyanate, and various reactive silicone oils, modified silicone oils, silicone modified resins (e.g. silicone modified acrylic resin), or fluorine modified resins (e.g. fluorine modified acrylic resin), reactive silicone resins (e.g. rubbers).

Particularly, silicone modified resins (e.g. silicone modified acrylic resin) or fluorine modified resins (e.g. fluorine modified acrylic resin), various silicone rubbers of heat curing type or room-temperature hardening type or liquid type, or various reactive silicone resins of condensed reaction type or additional reaction type, peroxide-hardening type or ultraviolet ray hardening type would be used independently.

The polymeric substance layer is formed by using at least polymeric substance. The polymeric substance is not particularly limited in material. The polymeric substance to be used for the dye anti-diffusion layer, the protecting layer or the dyeing layer can be used for this polymeric substance layer. A polymeric substance having a glass transition point more than 60° C. would be preferable.

By the way, the polymeric substance disclosed in this invention should be understood that it has a glass transition point or a softening point than that of the polymeric substance to be compared if its glass transition point or softening point is not mentioned.

The dyeing layer, the protecting layer, the dye anti-diffusion layer and/or the polymeric substance layer can contain various surface active agents. When the dyeing layer is formed on the releasing layer, it will be preferable to add surface active agent of fluorine group or the like to the paint for forming the dyeing layer to prevent repelling. (For example, "MEGAFAC" available from Dainippon Ink & Chemicals Inc.)

Polyvinyl acetal used for the dyeing layer, the protecting layer, the dye anti-diffusion layer and/or the polymeric substance layer can flexibly change print sensitivity in the dyeing layer or thermodurability in each layer by varying mixing ratio of its raw materials.

The top layer of the sequential laminate, such as a sequential laminate of the dyeing layer and the dye anti-diffusion layer or a sequential laminate of the dyeing layer, the protecting layer and the dye anti-diffusion layer or any other sequential laminate disclosed in this invention, acts as a film strength reinforcing member. Especially, in a gravure printing, it is difficult to form an uniform film excellent in surface smoothness; however, this invention makes it possible to form such an excellent film due to the existence of the top layer even when the film thickness of each layer is not larger than 2 μm, particularly less than 1.5 μm.

The coloring layers are formed by using at least coloring agent and binding agent. The color layers disclosed in the Japanese Patent Application No. HEI 4-196707/1992 can be used in this invention. The transfer medium may include a thermal-melting type color layer in addition to color layers containing sublimable (or diffusible) dyestuff. It is possible to use two transfer media, a transfer medium including sublimable color layers and a transfer medium including only a thermal-melting type color layer. The construction for providing the color layers on the support of the image-forming layer transfer medium is not particularly limited; therefore the color layers can be, for example, laid sequentially on a surface of the support as shown in FIG. 36.

Formation of each layer on the support is carried out by printing and/or coating. It is also possible to provide some layers on another medium beforehand and transfer them onto the support of the image-forming layer transfer medium. For example, when the dyeing layer or the like are formed on the support by gravure printing method, a plurality of image-forming layer transfer media identical with each other (e.g. 90 mm wide each) are printed on a wide support (e.g. 600 mm wide) and are, thereafter, separated into individual image-forming layer transfer media by slitting each along the longitudinal direction of the support.

Using an image-forming layer transfer medium, including at least a dyeing layer and a dye anti-diffusion layer or at least a dyeing layer, a protecting layer and a dye anti-diffusion layer (or above-described image-forming layer transfer medium), a sequential laminate of the dye anti-diffusion layer and the dyeing layer, a sequential laminate of the dye anti-diffusion layer, the protecting layer and the dyeing layer, or a sequential laminate of the protecting layer, the dye anti-diffusion layer and the dyeing layer can be formed on the intermediate medium. When image is printed in the dyeing layer, dyestuff of the dyeing layer cannot diffuse to or reach the intermediate medium due to the presence of a single layer of the dye anti-diffusion layer or a combination of the dye anti-diffusion layer and the protecting layer interposed between the intermediate medium and the dyeing layer.

Furthermore, when the sequential laminate carrying the print image is transferred from the intermediate medium to the image-receiving medium, the intermediate medium is not contaminated by the dyestuff because the dye anti-diffusion layer exists closer to the intermediate medium.

Especially, an image-forming layer transfer medium, including a sequential laminate of a dyeing layer, a protecting layer and a dye anti-diffusion layer formed on a support, the protecting layer having an area larger than that of the dyeing layer or the dye anti-diffusion layer, the protecting layer having a glass transition point or a softening point higher than that of the dyeing layer, and the dye anti-diffusion layer having a glass transition point or a softening point higher than that of the protecting layer, will not contaminate the intermediate medium because the protecting layer and the dye anti-diffusion layer have a glass transition point or a softening point higher than that of the dyeing layer. As a result, printed image is free from contamination by dyestuff, and the print density of the image obtained is satisfactory because no dyestuff is lost.

Furthermore, when the laminate is transferred onto the image-receiving medium, the dyeing layer carrying the print image is sandwiched between the image-receiving medium and the dye anti-diffusion layer. Therefore, in the fixing processing, it can be prevented that the dyeing layer is directly brought into contact with the fixing medium such as a fixing roller. Moreover, due to presence of the dye anti-diffusion layer on the surface of the dyeing layer, the fixing medium can be prevented from being contaminated by dyestuff. For example, when the fixing medium is a fixing roller, as the fixing roller is not contaminated after making one complete revolution, there is no possibility that the print image fixed in the first revolution of the fixing roller is transferred to a print portion to be fixed in the second revolution of the fixing roller.

In the case of an image-forming layer transfer medium including a support on which at least a dyeing layer and a dye anti-diffusion layer or at least a dyeing layer, a protecting layer and a dye anti-diffusion layer are formed to constitute a sequential laminate of the dyeing layer and the dye anti-diffusion layer, a sequential laminate of the dyeing layer, the protecting layer and the dye anti-diffusion layer, a sequential laminate of the dyeing layer, the dye anti-diffusion layer and the protecting layer, or a sequential laminate of the dyeing layer and the protecting layer, it may happen that the image-forming layer transfer medium is reserved in a wound condition at a high temperature. In such a case, covering the dyeing layer by the protecting layer and/or the dye anti-diffusion layer whose area are larger than that of the dyeing layer, or covering the dyeing layer by both the protecting layer and the dye anti-diffusion layer, or heightening the glass transition point or the softening point of the polymeric substance forming the protecting layer and/or the dye anti-diffusion layer than that of the polymeric substance forming the dyeing layer, would be effective to prevent the dyeing layer from being directly brought into contact with the reverse surface of the support in the wound condition, thus causing no thermal melting of the dyeing layer to the reverse surface of the support even if the dyeing layer has a low glass transition point or a softening point.

On the other hand, with respect to a low-temperature transfer, in a construction having a support and a sequential laminate of a dyeing layer and a dye anti-diffusion layer formed thereon, the dyeing layer having a glass transition point or a softening point lower than that of the dye anti-diffusion layer, and the dyeing layer having an area larger than that of the dye anti-diffusion layer, when the sequential laminate is transferred to an intermediate medium or an image-receiving medium, the transfer is smoothly carried out from an end region of the laminate due to existence of the dyeing layer having a low softening point at that end region. Easiness of overall transfer greatly depends on easiness of starting the transfer from the end region of the polymeric film. Thus, the construction and material of that end region of the film has a great affection.

Similarly, by letting a part of the dyeing layer protruding farther than the dye anti-diffusion layer so that the transfer begins from the protruding region, the transfer will be smoothly carried out even in low temperatures.

Furthermore, in an image-forming layer transfer medium including a support on which at least a dyeing layer, a protecting layer and a dye anti-diffusion layer are formed, if the dyeing layer has a glass transition point or a softening point lower than that of the protecting layer or the dye anti-diffusion layer and the dyeing layer has an area larger than that of the protecting layer or the dye anti-diffusion layer, the transfer of the sequential laminate from the transfer beginning point will be smoothly carried out at lower temperatures when the sequential laminate is transferred from the intermediate medium to the image-receiving medium.

Furthermore, in an image-forming layer transfer medium including a support on which at least a dyeing layer, a protecting layer and a dye anti-diffusion layer are formed, if there is formed a sequential laminate of the dyeing layer and the protecting layer or a sequential laminate of the dyeing layer and the dye anti-diffusion layer, the transfer beginning point of the laminate will be easily transferred at least to the intermediate medium at lower temperatures by lowering the glass transition point or the softening point of the dyeing layer than that of the protecting layer or the dye anti-diffusion layer, and by protruding a part of the dyeing layer farther than the protecting layer or the dye anti-diffusion layer.

Similarly, if there is formed a sequential laminate of the dyeing layer, the protecting layer and the dye anti-diffusion layer or a sequential laminate of the dyeing layer, the dye anti-diffusion layer and the protecting layer, the transfer beginning point of the laminate will be easily transferred to the intermediate medium or the image-receiving medium at lower temperatures by protruding a part of the dyeing layer farther than both of the protecting layer and the dye anti-diffusion layer.

Moreover, if the glass transition point or the softening point of the protecting layer is lower than that of the dye anti-diffusion layer, and the area of the protecting layer is larger than that of the dyeing layer or the dye anti-diffusion layer, and the protecting layer having a low softening point exists at an end of the laminate, the transfer beginning point of the laminate will be easily transferred to the image-receiving medium at lower temperatures.

Moreover, if a sequential laminate of the dyeing layer, the protecting layer and the dye anti-diffusion layer or a sequential laminate of the dyeing layer, the dye anti-diffusion layer and the protecting layer is formed on the support, or a sequential laminate of the dyeing layer and the protecting layer is formed on the support separately from the dye anti-diffusion layer, the transfer beginning point of the laminate will be easily transferred to the intermediate medium or the image-receiving medium at lower temperatures by lowering the glass transition point or the softening point of the protecting layer than that of the dye anti-diffusion layer, or by protruding a part of the protecting layer farther than the dyeing layer and/or the dye anti-diffusion layer.

Softening point is a softening temperature (Ts) measured by a flow tester, and is not a flow beginning temperature (Tfb). A preferable flow tester would be, for example, SHIMADZU FLOW TESTER CFT-500A or CFT-500C, manufactured by SHIMADZU Corporation.

EXAMPLE 1

* Image-forming Layer Transfer Medium

An image-forming layer transfer medium of this example 1 includes a polyethylene terephthalate (abbreviated PET) of 100 mm wide and 5 μm thick, having a slidable heat-resisting layer at a lower surface thereof and an anchor coat layer at an upper surface thereof. On the anchor coat layer, there is formed the construction identical with the image-forming layer transfer medium 3 shown in FIG. 1, using coating materials described below. Namely, a sequential laminate of a dyeing layer and a dye ant-diffusion layer is formed on the anchor coat layer via a releasing layer provided on the anchor coat layer, while yellow, magenta and cyan color layers are sequentially provided or printed on the anchor coat layer along a surface thereof, spaced from the sequential laminate of the dyeing layer and the dye ant-diffusion layer.

Furthermore, a plurality of sensor marks are printed on the anchor coat layer closely to the sequential laminate and each color layer to detect their positions respectively. After executing the printing by the gravure method, the image-forming layer transfer medium is dried.

As to film thicknesses, the releasing layer is 0.3 μm, the dyeing layer is approximately 1 μm, the dye anti-diffusion layer is approximately 1.5 μm, and each color layer is approximately 1 μm.

| | |
|---|---|
| *Releasing Layer Coating Material | |
| Silicone Resin (KS-847H, Shin-Etsu Chemical Co., Ltd.) | 10 weight part |
| Catalyst (CAT-PL-50T, Shin-Etsu Chemical Co., Ltd.) | 0.3 weight part |
| Toluene | 20 weight part |
| *Dyeing Layer Coating Material | |
| Polyvinyl butyral Resin [BL-S (Average polymerization degree: approximately 350, Tg: approximately 54° C.), Sekisui Chemical Co., Ltd.] | 4 weight part |
| Siloxane-containing Acrylsilicon Resin Solution (F-6A, effective component 54 wt %, Sanyo Chem. Ind. Ltd.) | 0.16 weight part |
| Di-n-butyltin dilaurate | 0.002 weight part |
| Fluorine-group Surface Active Agent | 0.012 weight part |
| Isopropyl Alcohol | 25 weight part |
| *Dye Anti-diffusion Layer Coating Material | |
| Acetoacetalized Polyvinyl Alcohol [KS-O (Average polymerization degree: approximately 300, Tg: approximately 110° C.), Sekisui Chemical Co., Ltd.] | 4 weight part |
| Isopropyl Alcohol | 10 weight part |
| 2-butanone | 15 weight part |
| *Yellow Color Layer Coating Material | |
| Pyridonazo-group Diffusible Coating Material | 3 weight part |
| Acrylonitrile-styrene copolymer Resin | 4 weight part |
| Amide-modified Silicone Oil | 0.04 weight part |
| Titanium Oxide (T805, Nippon Aerosil Co., Ltd.) | 0.24 weight part |
| Toluene | 25 weight part |
| 2-butanone | 25 weight part |
| *Magenta Color Layer Coating Material | |
| Azo-group Diffusible Coating Material | 3 weight part |
| Acrylonitrile-styrene copolymer Resin | 4 weight part |
| Amide-modified Silicone Oil | 0.04 weight part |
| Titanium Oxide (T805, Nippon Aerosil Co., Ltd) | 0.24 weight part |
| Toluene | 25 weight part |
| 2-butanone | 25 weight part |
| *Cyan Color Layer Coating Material | |
| Indoaniline-group Diffusible Coating Material | 3.5 weight part |
| Acrylonitrile-styrene copolymer Resin | 4 weight part |
| Amide-modified Silicone Oil | 0.04 weight part |
| Titanium Oxide (T805) | 0.24 weight part |
| Toluene | 25 weight part |
| 2-butanone | 25 weight part |

*Intermediate Medium

After forming an anchor coat layer (approximately 0.2 μm thick) on an outer surface of an endless film of polyimide (25 μm thick and approximately 200 mm long), a coating material, comprising polyester acrylate resin (M-S100, Toagosei Chem. Ind. Co., Ltd.) 10 weight part, sensitizer (IRGACURE 184, Ciba-Geigy (Japan) Ltd.) 0.3 weight part, and ethyl acetate 20 weight part, is coated on the anchor layer and then dried. Thereafter, a hardening film of 3 μm thick is formed by irradiating light emitted from a mercury lamp. A black sensor mark is provided on the intermediate medium to detect a position where the laminate (i.e. the laminate of the dye anti-diffusion layer and the dyeing layer in this example) is transferred.

An apparatus having the same construction as that of FIG. 1 is applied to the above-described example. An image-forming layer transfer medium explained above is assembled in a cassette, thus forming the image-forming layer transfer medium 3 of FIG. 1. An intermediate medium manufactured according to the above construction is used as the intermediate medium 11 of FIG. 1.

First of all, a first printing operation will be explained.

Position of the intermediate medium is adjusted using a sensor in such a manner that the black sensor mark comes to the position of the platen 2. After position of the laminate of the image-forming layer transfer medium 3 is detected by a sensor, the thermal head (i.e. printing head) is pushed to the platen 2 and, then, the thermal head generates heat, thereby transferring the laminate from the image-forming layer transfer medium to the intermediate medium. The following is transfer energy actuating conditions for this thermal head.

Transfer speed: 16.8 ms/line

Applied pulse width: 8 ms

Transfer energy: 8 J/cm$^2$

Next, using the yellow color layer of the image-forming layer transfer medium, yellow color gradation image is thermally transferred or printed in the dyeing layer of the intermediate medium. The following is conditions of this printing operation.

Printing speed: 16.8 ms/line

Printing pulse width: 0.8–8 ms

Maximum printing energy: 8 J/cm$^2$

Subsequently, magenta color and cyan color are successively printed in the dyeing layer of the intermediate medium in the same manner as the yellow color, thus forming a composite image of these three colors.

A post card is used as the image-receiving medium 12. The dyeing layer of the intermediate medium is overlapped with the post card at a position upstream of the silicone rubber roller 14 and the heating roller 15. Then, the heating roller 15 (a metallic roller accommodating a halogen lamp, with a 150° C. surface temperature, a 25 mm diameter and a 120 mm length) is pressed (at a 150N inter-roller load) against the silicone rubber roller 14 (a silicone rubber coated roller, with a 40° rubber hardness, a 25 mm diameter and a 120 mm length), the post card and the intermediate medium pass together through a clearance between the heating roller 15 and the silicone rubber roller 14 (at a 10 mm/s travelling speed), thus outputting the post card into the tray 21.

The printed image of the post card thus obtained revealed that the laminate was beautifully transferred from the intermediate medium to the post card. An obtained reflective print density of black color was 1.80 at the maximum pulse width 8 ms. It was proved that high-quality print image could be obtained with uniform dots in a wide range from a low print density to a high print density.

Next, a second print operation was conducted.

After a new laminate of a dye anti-diffusion layer and a dyeing layer is transferred from the image-forming layer transfer medium to the intermediate medium in the same manner as the first print operation, the laminate is thermally transferred from the intermediate medium to the image-receiving medium 12 (i.e. post card) without executing an image print operation using color layers of the image-forming layer transfer medium.

As a result of the above second operation, the laminate obtained on the post card revealed that no contamination was caused by dyestuff. Furthermore, it was also found that the intermediate medium was not contaminated by the dyestuff, too. This result apparently proves that the dye anti-diffusion layer interposed between the intermediate medium and the dyeing layer has surely performed its function of preventing the dyestuff from diffusing to and reaching the intermediate medium in the first image printing operation and the image transfer to the image-receiving medium.

EXAMPLE 2

* Image-forming Layer Transfer Medium

An image-forming layer transfer medium of this example 2 includes a PET film (100 mm wide and 5 μm thick), having a lower surface on which a slidable heat-resisting layer is formed and an upper surface on which a dye anti-diffusion layer, a dyeing layer and three, yellow, magenta and cyan, color layers are sequentially provided along a surface, separately from each other. The dye anti-diffusion layer and the dyeing layer are directly formed on the PET film, while each color layer is provided on the PET film via an anchor coat layer. The following coating materials are used for the formation of the dye anti-diffusion layer and the dyeing layer. The same coating materials as the example 1 are used for the formation of the yellow, magenta and cyan color layers. As to film thicknesses, the dye anti-diffusion layer is approximately 2.0 μm, the dying layer is approximately 1 μm, and each color layer is approximately 1 μm. Furthermore, a plurality of black sensor marks are printed on the PET film or the anchor coat layer to detect the position of each layer.

| *Dye Anti-diffusion Layer Coating Material | |
|---|---|
| Acetoacetalized Polyvinyl Alcohol (KS-O) | 3 weight part |
| Polyvinyl Butyral group Resin [BX-10 (Average polymerization degree: approximately 250, Tg: approximately 74° C.), Sekisui Chemical Co., Ltd.] | 1 weight part |
| Isopropyl Alcohol | 10 weight part |
| 2-butanone | 15 weight part |
| *Dyeing Layer Coating Material | |
| Polyvinyl butyral Resin [BL-3 (Average polymerization degree: approximately 300, Tg: approximately 68° C.), Sekisui Chemical Co., Ltd.] | 4 weight part |
| Siloxane-containing Acrylsilicone Resin Solution (F-6A) | 0.24 weight part |
| Di-n-butyltin dilaurate | 0.003 weight part |
| Isopropyl Alcohol | 10 weight part |
| 2-butanone | 15 weight part |

*Intermediate Medium

An endless film of polyimide (approximately 25 μm thick and approximately 200 mm long) is used as the intermediate medium. A black sensor mark is provided on the polyimide film to detect a position where the dye anti-diffusion layer or the like is transferred.

First, the dye anti-diffusion layer of the image-forming layer transfer medium is transferred onto the polyimide film acting as the intermediate medium by using the printing head. The following is transfer energy actuating conditions for this thermal head. Subsequently, the dyeing layer of the image-forming layer transfer medium is transferred onto the dye anti-diffusion layer first transferred, thereby forming a sequential laminate of the dye anti-diffusion layer and the dyeing layer on the intermediate medium.

Transfer speed: 16.8 ms/line

Applied pulse width: 8 ms

Transfer energy: 9 J/cm$^2$

Next, using each color layer of the image-forming layer transfer medium, three-color gradation image is thermally transferred or printed in the dyeing layer of the intermediate medium in the same manner as in the example 1. Subsequently, using a plain paper as the image-receiving medium, the laminate on the intermediate medium is transferred onto the plain paper in the same manner as in the example 1.

The printed image of the plain paper thus obtained revealed that the laminate was beautifully transferred from the intermediate medium to the plain paper. An obtained reflective print density of black color was 1.78 at the maximum pulse width 8 ms. It was proved that high-quality print image could be obtained with uniform dots in a wide range from a low print density to a high print density.

Next, a second print operation was conducted. After a new laminate of a dye anti-diffusion layer and a dyeing layer is transferred from the image-forming layer transfer medium to the intermediate medium in the same manner as the first print operation, the laminate is thermally transferred from the intermediate medium onto the plain paper without executing an image print operation using color layers of the image-forming layer transfer medium.

As a result of the above second operation, the laminate obtained on the plain paper revealed that no contamination was caused by dyestuff. Furthermore, it was also found that the intermediate medium was not contaminated by the dyestuff, too. This result apparently proves that the dye anti-diffusion layer interposed between the intermediate medium and the dyeing layer has surely performed its function of preventing the dyestuff from diffusing to and reaching the intermediate medium in the first image printing operation and the image transfer to the image-receiving medium.

EXAMPLE 3

The post card of the example 1, carrying print image, was applied a fixing process which made the post card pass through a clearance between the silicone rubber roller 14 (heating silicone rubber roller in this case) and the heating roller 15 in substantially the same conditions as the example 1, with the dyeing layer in a face-to-face relation to the silicone rubber roller 14, thereby fixing the laminate on the post card. The fixed image of the post card obtain had a surface glossiness of 5.8. A good writing feeling was recognized by a pencil. Although the laminate was brought into contact with the heating silicone rubber roller 14, it was found that the surface of the heating silicone rubber roller 14 was not at all contaminated by the print image.

EXAMPLE 4

The post card of the example 1, carrying print image, was applied a fixing process using the apparatus of FIG. 3 which is equipped with the fixing rollers (i.e. the metallic roller 40 and the heating silicone rubber roller 41), with the print image surface in a face-to-face relation to the heating silicone rubber roller 41. A 200N load was applied between the metallic roller 40 (with 25 mm diameter and a 120 mm length) and the heating silicone rubber roller 41 (with a 160° C. surface temperature, a 30° rubber hardness silicone rubber coat, a 25 mm diameter, a 120 mm length, and a built-in halogen lamp). The fixed image of the post card obtain had a surface glossiness of 5.7. A good writing feeling was recognized by a pencil. Although the laminate was brought into contact with the heating silicone rubber roller 41, it was found that the surface of the heating silicone rubber roller 41 was not at all contaminated by the print image.

EXAMPLE 5

* Image-forming layer transfer medium

The same structure as the image-forming layer transfer medium of the example 1.

* Intermediate medium

An endless film of polyimide (25 μm thick) with an elastic layer (approximately 50 μm thick) formed on the outer surface thereof using the following elastic layer coating materials. After the coating was finished, the elastic layer was applied a thermal processing for approximately 20 minutes at a 130° C. temperature.

| (Elastic Layer Coating Material) | |
|---|---|
| Silicone Resin (SD7328, Toray Dow Corning Silicone Co., Ltd) | 10 weight part |
| Silicon Adhesive Resin (SD4570, Toray Dow Corning Silicone Co., Ltd) | 10 weight part |
| Catalyst (SRX212, Toray Dow Corning Silicone Co., Ltd) | 0.4 weight part |
| Silica (AEROSIL, 200, Nippon Aerosil Co., Ltd) | 1 weight part |
| Silane Coupling Agent | 0.1 weight part |
| Toluene | 20 weight part |

An apparatus having the fundamental construction of FIG. 4 was applied to this example 5. Instead of the silicone rubber roller 14 and the heating roller 15 of FIG. 4, the roller 16 was used as the silicone rubber roller 14 and the roller 17 was used as the heating roller 15 for this example. Furthermore, the above-described intermediate medium was used as the intermediate medium 50.

Using the same process as the example 1, the laminate 28 was transferred from the image-forming layer transfer medium 3 to the elastic layer 51 of the intermediate medium 50. Then, the three-color printing operation to the dyeing layer on the intermediate medium 50 and the transfer of the laminate (using the rollers 16 and 17) from the intermediate medium to the post card was carried out. As a result, it was found that each process was nicely conducted. The transfer of the laminate from the intermediate medium to the post card was done under the conditions of approximately 150N inter-roller load and a 140° C. roller surface temperature.

When the laminate is transferred from the intermediate medium to the post card, the laminate is pressed into fibers of the post card by the elastic layer. In other words, the laminate is simultaneously fixed when it is transferred. Thus, in the comparison with an intermediate medium having no elastic layer, it was recognized that usage of the elastic layer made it possible to obtain a low-glossiness image by only one transfer operation. An obtained reflective print density of black color was 1.40 at the maximum pulse width 8 ms. It was proved that high-quality print image could be obtained with uniform dots in a wide range from a low print density to a high print density. The glossiness of the image surface was 7.0 and a good writing feeling was recognized by a pencil. It was also found that the surface of the elastic layer of the intermediate medium was not at all contaminated by the print image.

EXAMPLE 6

* Image-forming Layer Transfer Medium

An image-forming layer transfer medium of this example 6 includes a PET film (600 mm wide and 6 μm thick), having a slidable heat-resisting layer (back coat layer) at a lower surface thereof and an anchor coat layer at an upper surface thereof. On the anchor coat layer, there is formed the construction identical with the image-forming layer transfer medium shown in FIG. 37 by gravure printing technology, using coating materials described below. Namely, a sequential laminate of a dyeing layer, protecting layer and a dye anti-diffusion layer is formed on the anchor coat layer via a releasing layer provided on the anchor coat layer, while yellow, magenta and cyan color layers are sequentially provided or printed on the anchor coat layer along a surface thereof, spaced from the sequential laminate of the dyeing layer, the protecting layer and the dye ant-diffusion layer in a longitudinal direction of the PET film. Furthermore, a plurality of black sensor marks are printed on the anchor coat layer closely to detect the positions of the sequential laminate and each color layer in the same manner as FIG. 36. The black sensor mark is formed by using a commercially available gravure ink.

A gravure roller impression (82 mm×102 mm=8364 $mm^2$) used for the protecting layer was wider 1 mm at the edge thereof than those of the dyeing layer and the dye anti-diffusion layer. The gravure impressions of the dyeing layer and the dye anti-diffusion layer have the same area (80 mm×100 mm=8000 mm)

Centers of the dyeing layer, the protecting layer and the dye anti-diffusion layer are coincided. Namely, the edge of the protecting layer protrudes 1 mm outer than the dyeing layer, so that the dyeing layer is completely covered by the protecting layer.

A finally obtained image-forming layer transfer medium was 92 mm width. The gravure impression of the releasing layer was 388 mm×130 mm, and the gravure impression of each coloring layer was 388×130 mm.

After executing the printing operation of each layer, layers requiring hardening was hardened by applying hot air. As to film thicknesses, the releasing layer was 0.3 μm, the dyeing layer was approximately 1 μm, the protecting layer was approximately 1 μm, the dye anti-diffusion layer was approximately 2.0 μm, and each color layer was approximately 1 μm.

| *Releasing Layer Coating Material | |
|---|---|
| Silicone Resin (KS-847H) | 10 weight part |
| Catalyst (CAT-PL-50T) | 0.3 weight part |
| Toluene | 10 weight part |
| 2-butanone | 10 weight part |
| *Dyeing Layer Coating Material | |
| Polyvinyl butyral Resin | 4 weight part |

-continued

| | |
|---|---|
| (BL-S) | |
| Siloxane-containing Acrylsilicon Resin Solution (F-6A) | 0.10 weight part |
| Di-n-butyltin dilaurate | 0.0005 weight part |
| Isopropyl Alcohol | 12 weight part |
| 2-butanone | 9 weight part |
| *Protecting layer Coating Material | |
| Polyvinyl butyral Group Resin (BX-10) | 1.6 weight part |
| Acetoacetalized Polyvinyl Alcohol (KS-O) | 2.4 weight part |
| Isopropyl Alcohol | 12 weight part |
| 2-butanone | 9 weight part |
| *Dye Anti-diffusion Layer Coating Material | |
| Acetoacetalized Polyvinyl Alcohol (KS-O) | 4 weight part |
| Isopropyl Alcohol | 12 weight part |
| 2-butanone | 9 weight part |
| *Yellow Color Layer Coating Material | |
| Pyridonazo-group Diffusible Coating Material | 3 weight part |
| Acrylonitrile-styrene copolymer Resin | 2 weight part |
| Vinyl chloride-Vinyl acetate group copolymer resin | 2 weight part |
| Amide-modified Silicone Oil | 0.04 weight part |
| Titanium Oxide (T805) | 0.24 weight part |
| Toluene | 15 weight part |
| 2-butanone | 10 weight part |
| *Magenta Color Layer Coating Material | |
| Azo-group Diffusible Coating Material | 3 weight part |
| Acrylonitrile-styrene copolymer Resin | 2 weight part |
| Vinyl chloride-Vinyl acetate group copolymer resin | 2 weight part |
| Amide-modified Silicone Oil | 0.04 weight part |
| Titanium Oxide (T805) | 0.24 weight part |
| Toluene | 15 weight part |
| 2-butanone | 10 weight part |
| *Cyan Color Layer Coating Material | |
| Indoaniline-group Diffusible Coating Material | 3.5 weight part |
| Acrylonitrile-styrene copolymer Resin | 2 weight part |
| Vinyl chloride-Vinyl acetate group copolymer resin | 2 weight part |
| Amide-modified Silicone Oil | 0.04 weight part |
| Titanium Oxide (T805) | 0.24 weight part |
| Toluene | 15 weight part |
| 2-butanone | 10 weight part |

* Intermediate Medium

The same intermediate medium as the example 1 is used.

An apparatus having the same construction as that of FIG. 5 is applied to this example 6. An image-forming layer transfer medium explained above is assembled in a cassette, thus forming the image-forming layer transfer medium 54 of FIG. 5. An intermediate medium manufactured according to the above construction is used as the intermediate medium 11 of FIG. 5.

First of all, a first printing operation will be explained.

Position of the intermediate medium is adjusted using a black sensor in such a manner that the laminate comes to the position of the platen 2. After the sensor mark 29 (the left one in FIG. 5) indicating the position of the laminate 28 of the image-forming layer transfer medium 54 is detected by a sensor, the thermal head (i.e. printing head) 1 is pushed to the platen 2 and, then, the thermal head 1 generates heat, thereby transferring the laminate from the image-forming layer transfer medium to the intermediate medium, thus forming a laminate of the dye anti-diffusion layer, the protecting layer and the dyeing layer on the intermediate medium. The following is transfer energy actuating conditions for this thermal head.

Transfer speed: 16.8 ms/line

Applied pulse width: 8 ms

Transfer energy: 8.5 J/cm$^2$

Next, using the yellow color layer of the image-forming layer transfer medium, yellow color gradation image is thermally transferred or printed in the dyeing layer of the intermediate medium. The following is conditions of this printing operation.

Printing speed: 16.8 ms/line

Printing pulse width: 0.8–8 ms

Maximum printing energy: 8 J/cm$^2$

Subsequently, magenta color and cyan color are successively printed in the dyeing layer of the intermediate medium in the same manner as the yellow color, thus forming a composite image of these three colors (i.e. black color).

A post card is used as the image-receiving medium 12. The dyeing layer of the intermediate medium is overlapped with the post card at a position upstream of the silicone rubber roller 14 and the heating roller 15. Then, the heating roller 15 (a metallic roller accommodating a halogen lamp, with a 150° C. surface temperature, a 25 mm diameter and a 120 mm length) is pressed (at a 150N inter-roller load) against the silicone rubber roller 14 (a silicone rubber coated roller, with a 40° rubber hardness, a 25 mm diameter and a 120 mm length), the post card and the intermediate medium pass together through a clearance between the heating roller 15 and the silicone rubber roller 14 (at a 10 mm/s travelling speed), thus outputting the post card into the tray 21.

The printed image of the post card thus obtained revealed that the laminate was beautifully transferred from the intermediate medium to the post card. An obtained reflective print density of black color was 1.80 at the maximum pulse width 8 ms. It was proved that high-quality print image could be obtained with uniform dots in a wide range from a low print density to a high print density.

Next, a second print operation was conducted.

After a new laminate of a dyeing layer, a protecting layer and a dye anti-diffusion layer is transferred from the image-forming layer transfer medium to the intermediate medium in the same manner as the first print operation, the laminate is thermally transferred from the intermediate medium to the image-receiving medium 12 (i.e. post card) without executing an image print operation using color layers of the image-forming layer transfer medium.

As a result of the above second operation, the laminate obtained on the post card revealed that no contamination was caused by dyestuff. Furthermore, it was also found that the intermediate medium was not contaminated by the dyestuff, too. This result apparently proves that the dye anti-diffusion layer interposed between the intermediate medium and the dyeing layer has surely performed its function of preventing the dyestuff from diffusing to and reaching the intermediate medium in the first image printing operation and the image transfer to the image-receiving medium.

Moreover, even if the image-forming layer transfer medium manufactured was wound around a glass tube of approximately 25 mm outer diameter and kept in an atmosphere of 60° C., 60%RH for 300 hours, it was found that the dying layer did not cause a thermal melting with the slidable heat-resisting layer, and stably maintained on the releasing layer.

EXAMPLE 7

* Image-forming layer transfer medium

An image-forming layer transfer medium of the example 7 includes the same PET film as the example 6 having an anchor coat layer on which a releasing layer is partly formed by using the following coating material. On this releasing layer, there is formed a sequential laminate of a dyeing layer and a dye ant-diffusion layer. Furthermore, yellow, magenta and cyan color layers are formed on the anchor coat layer separately from each other, thereby manufacturing an image-forming layer transfer medium comprising the laminate and respective color layers sequentially formed on a surface by using the gravure printing technology and hot air processing in the same manner as the example 1. A gravure impression of the dye anti-diffusion layer was wider 1 mm at the edge thereof than that of the dyeing layer so that the area of the dye anti-diffusion layer became larger than that of the dyeing layer. Centers of the dyeing layer and the dye anti-diffusion layer are coincided in the printing. Namely, the dyeing layer is completely covered by the dye anti-diffusion layer.

In the same manner as the example 6, black sensor marks were printed near the laminate and each coloring layer to detect their positions, respectively. As to film thicknesses, the releasing layer was 0.3 μm, the dyeing layer was approximately 1.5 μm, the dye anti-diffusion layer was approximately 2.0 μm, and each color layer was approximately 1 μm.

| | |
|---|---|
| *Releasing Layer Coating Material | |
| Same composition as the example 6 | |
| *Dyeing Layer Coating Material | |
| Polyvinyl butyral Resin (BL-S) | 4 weight part |
| Siloxane-containing Acrylsilicon Resin Solution (F-6A) | 0.10 weight part |
| Di-n-butyltin dilaurate | 0.0005 weight part |
| Fluorine-group Surface Active Agent (F-179A, Dainippon Ink & Chemicals Inc.) | 0.08 weight part |
| Isopropyl Alcohol | 12 weight part |
| 2-butanone | 9 weight part |
| *Dye Anti-diffusion Layer Coating Material | |
| Acetoacetalized Polyvinyl Alcohol (KS-O) | 4 weight part |
| Isopropyl Alcohol | 12 weight part |
| 2-butanone | 9 weight part |

* Intermediate medium

The same intermediate medium as that of the example 1.

Under the same thermal head actuating conditions as the example 6, a laminate of a dyeing layer and a dye anti-diffusion layer was transferred from the image-forming layer transfer medium to the intermediate medium. Subsequently, print image was printed in the dyeing layer of the laminate on the intermediate medium in the same manner as the example 6, and then the laminate was thermally transferred from the intermediate medium onto the post card, thereby forming the print image on the post card.

The printed image of the post card thus obtained revealed that the laminate was beautifully transferred from the intermediate medium to the post card. An obtained reflective print density of black color was 1.81 at the maximum pulse width 8 ms. It was proved that high-quality print image could be obtained with uniform dots in a wide range from a low print density to a high print density.

Next, a second print operation was conducted.

After a new laminate of a dyeing layer and a dye anti-diffusion layer is transferred from the image-forming layer transfer medium to the intermediate medium in the same manner as the first print operation, the laminate is thermally transferred from the intermediate medium to the post card without executing an image print operation using color layers of the image-forming layer transfer medium.

As a result of the above second operation, the laminate obtained on the post card revealed that no contamination was caused by dyestuff. Furthermore, it was also found that the intermediate medium was not contaminated by the dyestuff, too. This result apparently proves that the dye anti-diffusion layer interposed between the intermediate medium and the dyeing layer has surely performed its function of preventing the dyestuff from diffusing to and reaching the intermediate medium in the first image printing operation and the image transfer to the image-receiving medium.

Moreover, even if the image-forming layer transfer medium manufactured was wound around a glass tube of approximately 25 mm outer diameter and kept in an atmosphere of 80° C., 80%RH for 300 hours, it was found that the dying layer did not cause a thermal melting with the slidable heat-resisting layer, and stably maintained on the releasing layer.

EXAMPLE 8

* Image-forming layer transfer medium

An image-forming layer transfer medium of the example 8 includes the same PET film as the example 8 having an anchor coat layer on which a releasing layer is partly formed by using the following coating material. On this releasing layer, there is formed a sequential laminate of a dyeing layer and a dye anti-diffusion layer by using the gravure printing technology and hot air processing, thereby manufacturing an image-forming layer transfer medium. A gravure impression of the dyeing layer was wider 2 mm at the edge thereof than that of the dye anti-diffusion layer so that the area of the dyeing layer became larger than that of the dye anti-diffusion layer. Centers of the dyeing layer and the dye anti-diffusion layer are coincided in the printing. As to film thicknesses, the releasing layer was 0.3 μm, the dyeing layer was approximately 1.5 μm, and the dye anti-diffusion layer was approximately 2.0 μm.

| | |
|---|---|
| *Releasing Layer Coating Material | |
| Same composition as the example 6 | |
| *Dyeing Layer Coating Material | |
| Polyvinyl butyral Resin (BL-3, Softening point: approximately 85° C.) | 4 weight part |
| Siloxane-containing Acrylsilicon Resin Solution (F-6A) | 0.10 weight part |
| Di-n-butyltin dilaurate | 0.0005 weight part |
| Fluorine-group Surface Active Agent (F-172, Dainippon Ink & Chemicals Inc.) | 0.08 weight part |
| Isopropyl Alcohol | 12 weight part |
| 2-butanone | 9 weight part |
| *Dye Anti-diffusion Layer Coating Material | |
| Acetoacetalized Polyvinyl Alcohol (Average polymerization degree: approximately 350, Acetalization degree: more than 70 mol %, Softening point: approximately 130° C.) | 4 weight part |
| Isopropyl Alcohol | 12 weight part |
| 2-butanone | 9 weight part |

* Intermediate medium

After forming an anchor coat layer (approximately 0.2 μm thick) on an outer surface of a film of polyimide (25 μm thick), a coating material, comprising polyester acrylate resin (M-8100) 10 weight part, sensitizer (IRGACURE 184) 0.3 weight part, and ethyl acetate 20 weight part, is coated on the anchor layer and then dried. Thereafter, a hardening film of 3 μm thick is formed by irradiating light emitted from a mercury lamp.

The laminate of the dyeing layer and the dye anti-diffusion layer formed on the image-forming layer transfer medium was overlapped with the hardening film of the intermediate medium. Then, the image-forming layer transfer medium and the intermediate medium passed through a clearance between the heating metallic roller (roller outer diameter: 50 mm) and the silicone rubber coated metallic roller (roller outer diameter: 50 mm, rubber thickness: 5 mm, hardness: 50°) in such a manner that the image-forming layer transfer medium is in a face-to-face relation with the heating metallic roller. The inter-roller load was 800N, and the passing speed was 10 mm/sec. Temperature of the heating metallic roller was varied in the test for finding an optimum temperature; it was found that 80° C. was preferable to transfer the laminate from the image-forming layer transfer medium to the intermediate medium.

EXAMPLE 9

* Image-forming layer transfer medium

An image-forming layer transfer medium of the example 9 includes the same PET film as the example 8 having an anchor coat layer on which a releasing layer is partly formed by using the following coating material. On this releasing layer, there is formed a sequential laminate of a dyeing layer and a dye anti-diffusion layer by using the gravure printing technology and hot air processing, thereby manufacturing an image-forming layer transfer medium. A gravure impression of the dyeing layer was the same as that of the dye anti-diffusion layer. However, printing was conducted under the condition that one edge of the dyeing layer (i.e. an edge along a longitudinal direction of the film) protruded approximately 1 mm outer than the edge of the dye anti-diffusion layer as shown in FIG. 15. As to film thicknesses, the releasing layer was 0.3 μm, the dyeing layer was approximately 1.5 μm, and the dye anti-diffusion layer was approximately 2 μm.

* Intermediate medium

The same construction as the example 8.

The laminate of the dyeing layer and the dye anti-diffusion layer formed on the image-forming layer transfer medium was overlapped with the intermediate medium. Then, the image-forming layer transfer medium and the intermediate medium passed through a clearance between the heating metallic roller and the silicone rubber coated metallic roller with a leading head of the protruding portion of the dyeing layer. Thus, the transfer tests was conducted in the same manner as the example 8. When the transfer medium was peeled off from the intermediate medium, a portion first peeled off was the protruding portion of the dyeing layer. Temperature of the heating metallic roller was varied in the test for finding an optimum temperature; it was found that 80° C. was preferable to transfer the laminate from the image-forming layer transfer medium to the intermediate medium.

EXAMPLE 10

* Image-forming layer transfer medium

An image-forming layer transfer medium of the example 10 includes the same PET film as the example 6 having an anchor coat layer on which a releasing layer is formed by using the same coating material. On this releasing layer, there is formed a sequential laminate of a dyeing layer, a protecting layer and a dye anti-diffusion layer, thereby manufacturing an image-forming layer transfer medium by using the gravure printing technology and hot air processing. A gravure impression of the protecting layer was wider 1 mm at the edge thereof than that of the dyeing layer and the dye anti-diffusion layer so that the area of the protecting layer became larger than that of the dyeing layer and the dye anti-diffusion layer. The area of the dyeing layer is identical with that of the dye anti-diffusion layer. The printing operation was conducted under the condition that the edge of the protecting layer protruded outer than the edge of the dyeing layer and the dye anti-diffusion layer. As to film thicknesses, the releasing layer was 0.3 μm, the dyeing layer was approximately 1 μm, the protecting layer was approximately 1.5 μm, and the dye anti-diffusion layer was approximately 1.5 μm.

* Intermediate medium

The same construction as the example 8.

The laminate formed on the image-forming layer transfer medium was overlapped with the intermediate medium. Then, the image-forming layer transfer medium and the intermediate medium passed through a clearance between the heating metallic roller and the silicone rubber coated metallic roller, thereby conducting the transfer tests in the same manner as the example 8. Temperature of the heating metallic roller was varied in the test for finding an optimum temperature; it was found that 90° C. was preferable to transfer the laminate from the image-forming layer transfer medium to the intermediate medium.

EXAMPLE 11

* Image-forming layer transfer medium

An image-forming layer transfer medium of the example 11 includes the same PET film as the example 8 having an anchor coat layer on which a releasing layer is formed by using the same coating material. On this releasing layer, there is formed a sequential laminate of a dyeing layer, a protecting layer and a dye anti-diffusion layer, thereby manufacturing an image-forming layer transfer medium by using the gravure printing technology and hot air processing. The coating paint of the protecting layer or the die anti-diffusion layer is the same as that of the example 8. The coating paint of the dyeing layer is described below. A gravure impression of the dyeing layer was wider 2 mm at the edge thereof than that of the protecting layer and the dye anti-diffusion layer so that the area of the dyeing layer became larger than that of the protecting layer and the dye anti-diffusion layer. Centers of the dyeing layer, the protecting layer and the dye anti-diffusion layer are coincided in the printing. The protecting layer and the dye anti-diffusion layer was the same in the area of their gravure impressions. As to film thicknesses, the releasing layer was 0.3 μm, the dyeing layer was approximately 1.5 μm, and the protecting layer was 1 μm, and the dye anti-diffusion layer was approximately 1.5 μm.

| *Dyeing Layer Coating Material | |
|---|---|
| Polyvinyl butyral Resin [BX-L (Average polymerization degree: approximately 300, Tg: approximately 65° C.), Sekisui Chemical Co., Ltd.] | 4 weight part |
| Siloxane-containing Acrylsilicon Resin Solution (F-6A) | 0.12 weight part |
| Di-n-butyltin dilaurate | 0.0005 weight part |
| Isopropyl Alcohol | 12 weight part |
| 2-butanone | 9 weight part |

* Intermediate medium

The same construction as the example 8.

The laminate formed on the image-forming layer transfer medium was overlapped with the intermediate medium. Then, the image-forming layer transfer medium and the intermediate medium passed through a clearance between the heating metallic roller and the silicone rubber coated metallic roller, thereby conducting the transfer tests in the same manner as the example 8. Temperature of the heating metallic roller was varied in the test for finding an optimum temperature; it was found that 80° C. was preferable to transfer the laminate from the image-forming layer transfer medium to the intermediate medium.

COMPARATIVE EXAMPLE 1

A PET film, coating materials and an intermediate medium used in this comparative example 1 are identical with those of the example 8 or have the same composition.

A gravure impression of the dyeing layer was narrower 2 mm at the edge thereof than that of the dye anti-diffusion layer. On the anchor coat layer of the PET film, there is formed a releasing layer on which the dyeing layer and the dye anti-diffusion layer are laminated, using the gravure printing technology and the hot air processing, thereby manufacturing the image-forming layer transfer medium layer which includes the dyeing layer completely covered by the dye anti-diffusion layer.

The image-forming layer transfer medium of this comparative example 1 was overlapped with the intermediate medium. Then, the image-forming layer transfer medium and the intermediate medium passed through a clearance between the heating metallic roller and the silicone rubber coated metallic roller, thereby conducting the transfer tests in the same manner as the example 8. An obtained result was that the transfer operation to the intermediate medium was failed at the temperature 80° C., and was not satisfactorily carried out even at the temperature 110° C. although a partial transfer was found only at the head portion of the laminate of the image-forming layer transfer medium.

COMPARATIVE EXAMPLE 2

A PET film, coating materials and an intermediate medium used in this comparative example 2 are identical with those of the example 9 or have the same composition.

A gravure impression of the dyeing layer was narrower 1 mm at the edge thereof than that of the dye anti-diffusion layer. On the anchor coat layer of the PET film, there is formed a releasing layer on which the dyeing layer and the dye anti-diffusion layer are sequentially laminated, using the gravure printing technology and the hot air processing, thereby manufacturing the image-forming layer transfer medium layer which includes the dyeing layer completely covered by the dye anti-diffusion layer.

The image-forming layer transfer medium of this comparative example 2 was overlapped with the intermediate medium. Then, the image-forming layer transfer medium and the intermediate medium passed through a clearance between the heating metallic roller and the silicone rubber coated metallic roller, thereby conducting the transfer tests in the same manner as the example 9. An obtained result was that the transfer operation to the intermediate medium was failed at the temperature 80° C., and was not satisfactorily carried out even at the temperature 110° C. although a partial transfer was found only at the head portion of the laminate of the image-forming layer transfer medium.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A thermal transfer printing method comprising the steps of:

transferring a sequential laminate from a transfer medium onto an intermediate medium by applying at least one of heat and pressure, said transfer medium having a support on which said sequential laminate is provided separately from a color layer which comprises a sublimable or diffusible dye, said sequential laminate consisting of a dyeing layer and a dye anti-diffusion layer, wherein said dye anti-diffusion layer has a glass transition point or a softening point higher than that of said dying layer by an amount not less than 200 g, thereby forming a laminate on the intermediate medium;

laying said color layer on the top of the laminate formed on the intermediate medium so that said color layer of the transfer medium is brought into contact with said dyeing layer of the laminate;

forming a thermal dye transfer image in said dying layer of the laminate formed on said intermediate medium by heating said transfer medium with a printing head; and transferring said laminate carrying the thermal dye transfer image thereon from said intermediate medium onto an image-receiving medium by applying at least one of heat and pressure, thereby finally forming a print image on the image-receiving medium.

2. The thermal transfer printing method in accordance with claim 1, wherein said transfer medium is divided into a plurality of transfer media including an image-forming layer transfer medium having a support on which a sequential laminate consisting of the dyeing layer and the dye anti-diffusion layer is formed and a dye transfer medium having a support on which the color layer is formed.

3. The thermal transfer printing method in accordance with claim 1, wherein a releasing layer is interposed between the support and at least one of the dyeing layer and the dye anti-diffusion layer.

4. The thermal transfer printing method in accordance with claim 1, further comprising a fixing step of fixing the laminate on the image-receiving medium by applying at least one of heat and pressure.

5. The thermal transfer printing method in accordance with claim 1, wherein said intermediate medium includes an elastic layer formed thereon.

6. A thermal transfer printing method comprising the steps of:

transferring a dye anti-diffusion layer from a transfer medium onto an intermediate medium by applying at least one of heat and pressure, and subsequently transferring a dyeing layer from said transfer medium onto said dye anti-diffusion layer formed on the intermediate medium by applying at least one of heat and pressure, said transfer medium having a support on which said dye anti-diffusion layer, said dyeing layer and a color layer are separately provided, said color layer comprising a sublimable or diffusible dye, thereby forming a sequential laminate consisting of the dye anti-diffusion layer and the dyeing layer on the intermediate medium;

laying said color layer on the top of the laminate formed on the intermediate medium so that said color layer of the transfer medium is brought into contact with said dyeing layer of the laminate;

forming a thermal dye transfer image in said dyeing layer of the laminate formed on the intermediate medium by heating the transfer medium with a printing head; and transferring said laminate carrying the thermal dye transfer image thereon from said intermediate medium onto an image-receiving medium by applying at least one of heat and pressure, thereby finally forming a print image on the image-receiving medium.

7. The thermal transfer printing method in accordance with claim 6, wherein said transfer medium is divided into a plurality of transfer media including an image-forming layer transfer medium having a support on which the dyeing layer and the dye anti-diffusion layer are formed separately from each other and a dye transfer medium having a support on which the color layer is formed.

8. The thermal transfer printing method in accordance with claim 6, wherein said transfer medium is divided into a plurality of transfer media including a transfer medium having a support on which the dyeing layer is formed, a transfer medium having a support on which the dye anti-diffusion layer is formed, and a dye transfer medium having a support on which the color layer is formed.

9. A thermal transfer printing method comprising the steps of:

transferring a dyeing layer, a protecting layer, and a dye anti-diffusion layer from a transfer medium onto an intermediate medium by applying at least one of heat and pressure, said transfer medium having support on which said dyeing layer, said protecting layer and said dye anti-diffusion layer are formed separately from a color layer which comprises a sublimable or diffusible dye, thereby forming a sequential laminate on the intermediate medium, selected from the group consisting of a laminate consisting of the dye anti-diffusion layer, the protecting layer and the dyeing layer sequentially piled up in this order and a laminate consisting of the protecting layer, the dye anti-diffusion layer and the dyeing layer sequentially piled up in this order;

laying said color layer on the top of the laminate formed on the intermediate medium so that said color layer of the transfer medium is brought into contact with said dyeing layer of the laminate;

forming a thermal dye transfer image in said dyeing layer of the laminate formed on the intermediate medium by heating the transfer medium with a printing head; and transferring said laminate carrying the thermal dye transfer image thereon from said intermediate medium onto an image-receiving medium by applying at least one of heat and pressure, thereby finally forming a print image on the image-receiving medium.

10. The thermal transfer printing method in accordance with claim 9, wherein said transfer medium is selected from the group consisting of a transfer medium having a support on which a laminate consisting of the dyeing layer, the protecting layer and the dye anti-diffusion layer sequentially piled up in this order is formed separately from the color layers and a transfer medium having a support on which a laminate consisting of the dyeing layer, the dye anti-diffusion layer and the protecting layer sequentially piled up in this order is formed separately from the color layers.

11. The thermal transfer printing method in accordance with claim 9 or 10, wherein said transfer medium is divided into a plurality of transfer media including an image-forming layer transfer medium having a support on which the dyeing layer, the protecting layer and the dye anti-diffusion layer are formed and a dye transfer medium having a support on which the color layer is formed.

12. The thermal transfer printing method in accordance with any one of claims 1, 6, 2, 7, 8, 9, and 10, wherein said intermediate medium includes an elastic layer formed thereon, said elastic layer fixing the laminate on the image-receiving medium at the moment when the laminate is transferred onto the image-receiving medium, or said elastic layer fixing the laminate after being transferred onto the image-receiving medium.

13. The thermal transfer printing method in accordance with claim 9, wherein a releasing layer is interposed between the support and at least one of the dyeing layer, the dye anti-diffusion layer and the protecting layer.

* * * * *

UNITED STATES PATENT AND TRADEMARK OFFICE

CERTIFICATE OF CORRECTION

PATENT NO. : 5,545,605

DATED : August 13, 1996

INVENTOR(S) : Akihiro IMAI et al.

It is certified that error appears in the above-identified patent and that said Letters Patent is hereby corrected as shown below:

Column 34, line 8, change "200 g" to --20°C.--.

Signed and Sealed this

Eighteenth Day of March, 1997

*Attest:*

*Attesting Officer*

Bruce Lehman

BRUCE LEHMAN

*Commissioner of Patents and Trademarks*